US011433452B2

(12) United States Patent
Marcin, Jr. et al.

(10) Patent No.: US 11,433,452 B2
(45) **Date of Patent: *Sep. 6, 2022**

(54) COUNTERGRAVITY CASTING APPARATUS AND DESULFURIZATION METHODS

(71) Applicant: Raytheon Technologies Corporation, Farmington, CT (US)

(72) Inventors: John J. Marcin, Jr., Marlborough, CT (US); Alan D. Cetel, West Hartford, CT (US); Mario P. Bochiechio, Vernon, CT (US); Reade R. Clemens, Plainville, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/599,646

(22) Filed: Oct. 11, 2019

(65) Prior Publication Data

US 2020/0038942 A1 Feb. 6, 2020

Related U.S. Application Data

(62) Division of application No. PCT/US2018/057675, filed on Oct. 26, 2018.

(Continued)

(51) Int. Cl.

*B22D 1/00* (2006.01)
*B22D 18/04* (2006.01)

(Continued)

(52) U.S. Cl.

CPC ..... *B22D 1/00* (2013.01); *B22D 1/007* (2013.01); *B22D 18/06* (2013.01); *B22D 21/025* (2013.01); *B22D 23/00* (2013.01); *C22B 9/02* (2013.01)

(58) Field of Classification Search

CPC ..... B22C 9/086; B22D 1/00; B22D 1/007; B22D 18/04; B22D 18/06; B22D 21/025; B22D 23/00; B22D 43/004; C22B 9/02

(Continued)

(56) References Cited

U.S. PATENT DOCUMENTS 4,982,777 A 1/1991 Chandley
5,038,846 A 8/1991 Doty (Continued)

FOREIGN PATENT DOCUMENTS

CN 201357220 Y 12/2009
EP 0473062 A2 3/1992
WO 01/89743 A1 11/2001

OTHER PUBLICATIONS

Office Action dated Oct. 9, 2020 for U.S. Appl. No. 16/604,367.

(Continued)

*Primary Examiner* — Kevin P Kerns

(74) *Attorney, Agent, or Firm* — Bachman & LaPointe, P.C.

(57) ABSTRACT

An apparatus for countergravity casting a metallic has: a crucible for holding melted metallic material; a casting chamber for containing a mold; a fill tube capable of extending into the crucible to communicate melted metallic material to the casting chamber; and a gas source coupled to a headspace of the melting vessel to allow the gas source to pressurize said headspace to establish a pressure differential to force the melted metallic material upwardly through said fill tube into the mold. Added sulfur-gettering particles subsequently filtered or sulfur-gettering material removes sulfur from the melted metallic material.

21 Claims, 15 Drawing Sheets

Related U.S. Application Data

(60) Provisional application No. 62/578,226, filed on Oct. 27, 2017.

(51) Int. Cl.

| | |
|---|---|
| ***B22D 18/06*** | (2006.01) |
| ***B22D 23/00*** | (2006.01) |
| ***B22C 9/08*** | (2006.01) |
| ***B22D 21/02*** | (2006.01) |
| *C22B 9/02* | (2006.01) |

(58) Field of Classification Search
USPC ..... 164/119, 306, 55.1, 134, 358
See application file for complete search history.

(56) References Cited

U.S. PATENT DOCUMENTS

| | | | | |
|---|---|---|---|---|
| 5,146,973 | A * | 9/1992 | Chandley | B22D 18/06 164/255 |
| 5,346,563 | A | 9/1994 | Allen et al. | |
| 5,922,148 | A | 7/1999 | Irvine et al. | |
| 6,102,983 | A | 8/2000 | Skaland | |
| 6,216,768 | B1 | 4/2001 | Daussan et al. | |
| 6,499,529 | B1 | 12/2002 | Farkas | |
| 6,684,934 | B1 | 2/2004 | Cargill et al. | |
| 9,138,963 | B2 | 9/2015 | Cetel et al. | |
| 2003/0170489 | A1 | 9/2003 | Allen et al. | |
| 2011/0240245 | A1 | 10/2011 | Schlienger et al. | |
| 2014/0178245 | A1 | 6/2014 | Cetel et al. | |
| 2014/0271341 | A1 | 9/2014 | Barrett et al. | |
| 2016/0053346 | A1 | 2/2016 | Szuromi et al. | |
| 2018/0354026 | A1 | 12/2018 | Shendye et al. | |
| 2020/0156147 | A1* | 5/2020 | Marcin, Jr. et al. | B22D 18/04 |

OTHER PUBLICATIONS

European Search Report dated May 20, 2020 for European Patent Application No. 18869618.1.

Paul Bates et al., "The Use of Ceramic Foam Filters in the Production of High Integrity Steels and Ni-Based Alloys", Jan. 1, 1992, pp. 682-684, vol. 32, No. 5, ISIJ international, Tokyo, Japan.

V.V. Sidorov et al., "Influence of the Rate of Infiltration of a Complexly Alloyed Nickel Melt through a Foam-Ceramic Filter on the Sulfur Impurity Content in the Metal", Russian Metallurgy, Oct. 13, 2015, pp. 487-489, vol. 2015, No. 6, Pleiades Publishing Ltd., New York, New York.

International Search Report and Written Opinion dated Apr. 29, 2019 for PCT/US18/57675.

John R. Brown, editor, "Foseco Ferrous Foundryman's Handbook", Aug. 1, 2000, Butterworth-Heinemann, Woburn, Massachusetts.

Erwin Dotsch, "Metallurgy of Induction Melting Processes for Iron and Non-Iron Materials", ASM Handbook, Oct. 2014, pp. 474-490, vol. 4C, ASM International, Novelty, Ohio.

Revised by Douglas White, Elkem Materials, Inc., "Production of Ductile Iron Castings", ASM Handbook, May 2017, vol. 1A, ASM International, Novelty, Ohio.

R.I.L. Guthrie et al., McGill Metals Processing Center, McGill University, "Steel Processing Technology", ASM Handbook, Apr. 1990, vol. 1, ASM International, Novelty, Ohio.

Dan Herring, "Backstreaming", Jan. 8, 2013, VAC AERO International, Inc., Ontario,Canada, Retrieved from internet Oct. 13, 2017 https://vacaero.com/information-resources/the-heat-treat-doctor/1285-backstreaming.html.

U.S. Office action dated May 6, 2021 for U.S. Appl. No. 16/604,367.

* cited by examiner

COUNTERGRAVITY CASTING APPARATUS AND DESULFURIZATION METHODS

CROSS-REFERENCE TO RELATED APPLICATIONS

This is a divisional of International Application No. PCT/US2018/057675, filed Oct. 26, 2018, and entitled "Countergravity Casting Apparatus and Desulfurization Methods", which claims benefit of U.S. Provisional Patent Application No. 62/578,226, filed Oct. 27, 2017, and entitled "Countergravity Casting Apparatus and Desulfurization Methods", the disclosure of which applications are incorporated by reference herein in their entirety as if set forth at length.

BACKGROUND

The disclosure relates to countergravity casting of nickel-based superalloys. More particularly, the disclosure relates to control of sulfur contamination in such casting.

Components used in the hot sections of gas turbine engines are typically formed of cast nickel-based superalloys. U.S. Pat. No. 6,684,934 (the '934 patent) to Cargill et al., Feb. 3, 2004, "Countergravity casting method and apparatus", the disclosure of which is incorporated by reference in its entirety herein as if set forth at length, discloses a countergravity casting method and apparatus.

Countergravity casting relies on differential pressure or vacuum levels to draw metal from a holding melt vessel up vertically into an inverted casting mold through a sprue nozzle). This process has several advantages over conventional gravity investment casting such as the ability to fill more parts and finer features due to the pressure assistance provided by the differential pressure of vacuum levels. The process returns non-component gating material back to the molten metal crucible to conserve the use of metal for a more efficient process. Because of these advantages, turbine engine hot section components such as combustor liners (floatwall panels), combustor bulkhead panels, and nozzle structural frames have used this process extensively for equiax multicrystalline cast components.

Due to the increase in combustor temperatures and the increased oxidation and corrosion atmosphere of new combustors, single crystal combustor liners are being used and developed to reduce oxidation and enhance thermal fatigue life. To further enhance oxidation life, desulfurized alloys have been used to cast both multicrystalline and single crystal components. Examples are found in U.S. Pat. No. 9,138,963 (the '963 patent) to Cetel et al., Sep. 22, 2015, "Low sulfur nickel base substrate alloy and overlay coating system", the disclosure of which is incorporated by reference in its entirety herein as if set forth at length The low sulfur enables the protective coatings to adhere for longer periods of time at temperature. It has been demonstrated that the desulfurizing effect on the alloy can be retained in conventional gravity casting but is lost with the countergravity process for multicrystalline components.

SUMMARY

One aspect of the disclosure involves a countergravity casting apparatus comprising: a melting crucible; a casting mold; a flowpath from the melting crucible to the casting mold; and a filter along the flowpath. At least one of: the filter comprises a sulfur-gettering material; and a source of sulfur-gettering particles is upstream of the filter and the filter is effective to filter the sulfur-gettering particles.

Further embodiments of any of the foregoing embodiments may additionally and/or alternatively include said source of sulfur-gettering particles.

Further embodiments of any of the foregoing embodiments may additionally and/or alternatively include the sulfur gettering ability of the sulfur gettering particles being at least that of 20 weight percent MgO in $ZrO_2$.

Further embodiments of any of the foregoing embodiments may additionally and/or alternatively include the sulfur-gettering particles comprising MgO.

Further embodiments of any of the foregoing embodiments may additionally and/or alternatively include the mold having a cavity shaped to form a gas turbine engine component.

Further embodiments of any of the foregoing embodiments may additionally and/or alternatively include the mold having a cavity shaped to form a gas turbine engine combustor panel.

Further embodiments of any of the foregoing embodiments may additionally and/or alternatively include a method for using the apparatus. The method comprises: melting a nickel-based superalloy in the melting crucible; introducing the sulfur-gettering particles from the source to the melted nickel-base superalloy upstream of the filter, the sulfur-gettering particles then gettering sulfur to become sulfur-containing particles; disposing the casting mold under subambient pressure on a mold base with a fill tube of said mold extending through an opening in said base; relatively moving said melting vessel and said base to immerse an opening of said fill tube in the melted nickel-based superalloy in said melting vessel and to engage said melting vessel and said base with seal means therebetween such that a sealed gas pressurizable space is formed between the melted nickel-based superalloy and said base; and gas pressurizing said space to establish a pressure differential on the melted nickel-based superalloy to force it upwardly through said fill tube into said casting mold, the melted nickel-based superalloy passing through the filter which filters the sulfur-containing particles.

Another aspect of the disclosure involves an apparatus for countergravity casting a metallic material. The apparatus comprises: a melting vessel having at least a surface layer of a sulfur-gettering material of greater sulfur-gettering ability than alumina and zirconia; a casting chamber for containing a mold; a fill tube capable of extending into the melting vessel to communicate melted metallic material to the casting chamber; a gas source coupled a headspace of the melting vessel to allow the gas source to pressurize said headspace to establish a pressure differential to force the melted metallic material upwardly through said fill tube into said mold.

Further embodiments of any of the foregoing embodiments may additionally and/or alternatively include the sulfur gettering ability being at least that of 20 weight percent MgO in $ZrO_2$.

Further embodiments of any of the foregoing embodiments may additionally and/or alternatively include the mold having a cavity shaped to form a gas turbine engine component.

Further embodiments of any of the foregoing embodiments may additionally and/or alternatively include the mold having a cavity shaped to form a gas turbine engine combustor panel.

Further embodiments of any of the foregoing embodiments may additionally and/or alternatively include the sulfur-gettering material comprising MgO.

Another aspect of the disclosure involves a method for modifying a countergravity casting apparatus from a first condition to a second condition. In the first condition the countergravity casting apparatus has sulfur contamination of cast metallic material. The method comprises at least one of: replacing an oil-sealed pump with an oil-less pump; adding at least a sulfur-gettering layer to a crucible; adding at least a sulfur-gettering layer to a mold; adding a sulfur-gettering filter; adding a contaminant trap along a vacuum flowpath through a vacuum pump; reducing contaminants in a pressurizing gas source; adding sulfur-gettering material along a fill tube; and adding a source of particulate sulfur-gettering material.

Another aspect of the disclosure involves a method for countergravity casting a nickel-based superalloy. The method comprises: melting the nickel-based superalloy; disposing a mold under subambient pressure on a mold base with a fill tube of said mold extending through an opening in said base; relatively moving said melting vessel and said base to immerse an opening of said fill tube in the melted nickel-based superalloy in said melting vessel and to engage said melting vessel and said base with seal means therebetween such that a sealed gas pressurizable space is formed between the melted nickel-based superalloy and said base; and gas pressurizing said space to establish a pressure differential on the melted nickel-based superalloy to force it upwardly through said fill tube into said mold, the melted nickel-based superalloy passing through a filter which at least one of: reduces sulfur content of the passed melted nickel-based superalloy; and filters sulfur-containing particles.

Further embodiments of any of the foregoing embodiments may additionally and/or alternatively include introducing sulfur-gettering particles to the melted nickel-base superalloy upstream of the filter, the sulfur-gettering particles then gettering sulfur to become the sulfur-containing particles.

Further embodiments of any of the foregoing embodiments may additionally and/or alternatively include the filter comprising a sulfur-gettering material.

Further embodiments of any of the foregoing embodiments may additionally and/or alternatively include solidifying the melted nickel-base superalloy to block the fill tube.

Another aspect of the disclosure involves an apparatus for countergravity casting a metallic material. The apparatus comprises: a crucible for holding melted metallic material; a casting chamber for containing a mold; a fill tube capable of extending into the crucible to communicate melted metallic material to the casting chamber; and a gas source coupled a headspace of the melting vessel to allow the gas source to pressurize said headspace to establish a pressure differential to force the melted metallic material upwardly through said fill tube into said mold, wherein at least one of: the crucible has at least a sulfur-gettering layer; the mold has at least a sulfur-gettering layer; the apparatus further comprises as a sulfur-gettering filter; the apparatus further comprises a contaminant trap along a vacuum flowpath through a vacuum pump; reducing contaminants in a pressurizing gas source; the fill tube has at least a sulfur-gettering layer; the apparatus further comprises a source of sulfur-gettering material for exposure to a vacuum environment within the system; and the apparatus further comprises a source of particulate sulfur-gettering material for introduction to the melted material.

Another aspect of the disclosure involves an apparatus for countergravity casting a metallic material. The apparatus comprises: a crucible for holding melted metallic material; a casting chamber for containing a mold; a fill tube capable of extending into the crucible to communicate melted metallic material to the casting chamber; a gas source coupled a headspace of the melting vessel to allow the gas source to pressurize said headspace to establish a pressure differential to force the melted metallic material upwardly through said fill tube into said mold; and means for gettering sulfur.

Further embodiments of any of the foregoing embodiments may additionally and/or alternatively include the means comprising material having sulfur gettering ability at least that of 20 weight percent MgO in $ZrO_2$.

Further embodiments of any of the foregoing embodiments may additionally and/or alternatively include the means comprising at least one of MgO and CaO.

Further embodiments of any of the foregoing embodiments may additionally and/or alternatively include the means comprising a filter.

Further embodiments of any of the foregoing embodiments may additionally and/or alternatively include the means comprising a ceramic filter.

Further embodiments of any of the foregoing embodiments may additionally and/or alternatively include methods for casting wherein the means getters sulfur. Further embodiments of any of the foregoing embodiments may additionally and/or alternatively include methods for remanufacturing or reengineering an apparatus or configuration thereof to add the means.

Another aspect of the disclosure involves a method for countergravity casting a nickel-based superalloy. The method comprises: melting the nickel-based superalloy; disposing a mold under subambient pressure on a mold base with a fill tube of said mold extending through an opening in said base; relatively moving said melting vessel and said base to immerse an opening of said fill tube in the melted nickel-based superalloy in said melting vessel; gas pressurizing a space to establish a pressure differential on the melted nickel-based superalloy to force it upwardly through said fill tube into said mold; and a step for removing sulfur. The details of one or more embodiments are set forth in the accompanying drawings and the description below. Other features, objects, and advantages will be apparent from the description and drawings, and from the claims.

BRIEF DESCRIPTION OF THE DRAWINGS

For purposes of illustration, the drawings are a markup of those of the '934 patent as an exemplary baseline with added detail views.

Like reference numbers and designations in the various drawings indicate like elements.

DETAILED DESCRIPTION

Figures 1, 1A:
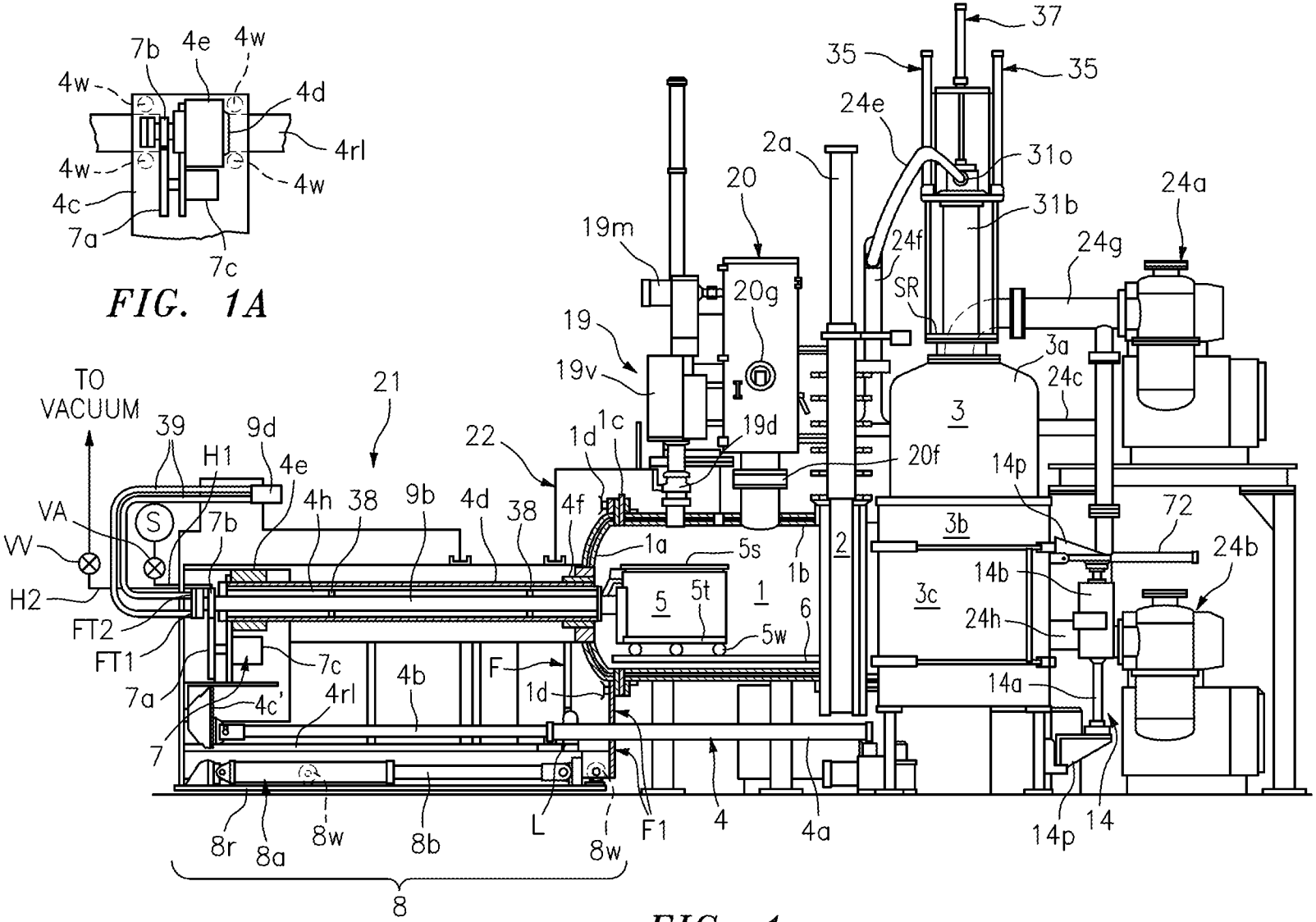
FIG. 1 is an elevational view of a casting apparatus with certain apparatus components shown in section.
FIG. 1A is a partial elevational view of a wheeled shaft platform with the shaft broken away showing the wheels on a rail located behind the platform adjacent the induction power supply.

It is suspected that the countergravity casting sulfur contamination is due to the long duration of melting in a holding vessel and the general pickup of sulfur from the refractories, molten pool, equipment, and environment. In conventional vacuum (or protective atmosphere) casting, a small amount of metal is melted and then immediately used for a single pour. Countergravity may cast several (e.g., five to ten) sequential molds from the same melt crucible. Also, upon pressure release after a given mold is full, excess material in the sprue will return to the source. Any contaminants acquired by this returned/reclaimed excess material may contaminate subsequent draws of the metal.

Below, a number of techniques are disclosed for reducing sulfur contamination of the part(s) being cast by reducing sulfur introduction at various stages and/or removing sulfur contaminants from the alloy. These may be used in any physically possible combination.

An exemplary goal is to avoid casting the part with sulfur levels above those (if any) of the source superalloy ingots. However, this does not preclude use to merely limit any increase in sulfur content to an acceptable amount. It also does not preclude use to reduce sulfur content below that of the source superalloy ingots.

Exemplary implementations are discussed relative to the system and methods of the '934 patent and what are believed to be further details of that system's construction. Nevertheless, similar modifications may be made to other countergravity systems. Exemplary implementations involve particular alloys in the table of the '963 patent and the more generic ranges of alloy compositions in the '963 patent.

The '934 patent identifies crucible material for melting metal being alumina or zirconia ceramic. A first area for modification is to form the crucible from or to include a sulfur-gettering material such as MgO. Alumina and zirconia have some gettering ability, but a greater gettering ability is desirable. Other such sulfur gettering materials include CaO, LaO, $Y_2O_3$, or other rare earth element oxide(s) with greater sulfur affinity than $ZrO_2$.

The MgO may represent a surface layer 1000 (added FIG. 4C) (e.g., at least 0.010 inch (0.25 mm) thick or an exemplary 0.25 mm to 2.0 mm) on a substrate 1002 or may be the full ceramic thickness. Exemplary MgO content (or combination of other materials above) in this layer is at least 20 weight percent or at least 50 weight percent. The sulfur affinity of this layer (regardless of composition) should thus be at least that of a 20 weight percent MgO in $ZrO_2$.

The crucible or its substrate may be made by slip casting, injection molding, powder densification, or slurry dipping (as discussed for molds below). When a layer is used, it may be made via initial dipping in a slurry process or by spraying or painting into a substrate or slip casting in a substrate or other coating technique.

Figure 7B:
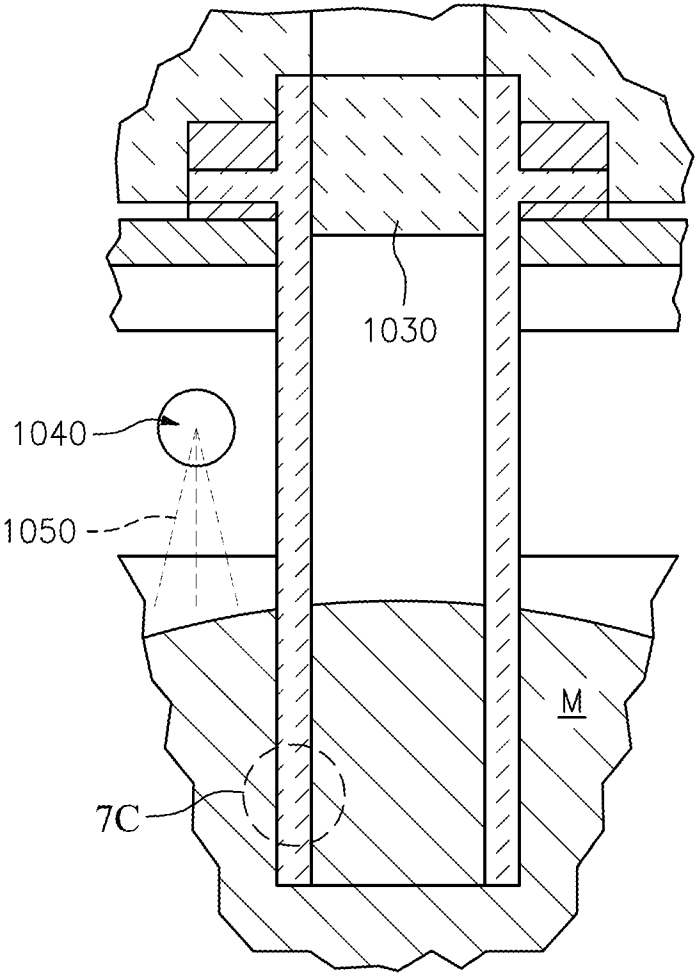
FIG. 7B is a sectional view of a snout having a filter.
Figure 7A:
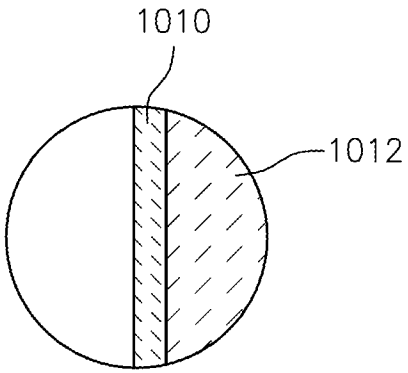
FIG. 7A is a sectional view of a sulfur-gettering layer on a mold substrate.

Similarly, the casting mold itself may be modified to include such a sulfur-gettering material. Because the casting molds are typically single-use items and also made of ceramic, different circumstances may attend molds vs. crucibles. The mold may include the sulfur-gettering material as a thin layer 1010 (added FIG. 7A) along the internal cavity of a mold formed from an alumina or zirconia substrate 1012 (e.g., at least having lower content of the MgO, etc.). Exemplary layer thickness is at least 0.010 inch (0.25 mm) thick or an exemplary 0.25 mm to 2.0 mm) or may be the full ceramic thickness of the shell (typically 0.5 inch to 0.75 inch (127 mm to 19 mm), more broadly 10 mm to 30 mm). Exemplary MgO content (or combination of other materials above) in this layer is at least 20 weight percent or at least 50 weight percent.

The layer may be applied by sequentially dipping an investment casting pattern in a gettering media slurry to form a prime coat. Exemplary dipping is in an MgO slurry (e.g., using a colloidal binder system such as silica or alumina as carrier). The typical particle sizes of the ceramic component of the slurry is 200 to 300 mesh but can be larger or smaller depending on the metal cast and the desired surface finish. The slurry dip is immediately followed by an application of dry stucco ceramic particulates with are impinged on the still-wet slurry. The dry stucco particulates can be MgO or another sulfur-gettering rare earth oxide. The slurry/stucco combination form the primecoat of the casting mold and will be the layer in contact with the molten metal during casting. After the slurry and stucco is applied, the mold is intermittently dried under controlled temperature and humidity.

Several dips may be applied to form multiple layers of primecoat. Then several layers of bulk material are applied on top of the prime layer(s) which have larger particle sizes of ceramic component in the slurry and stucco. This builds up a thickness of ceramic shell that can hold up to the casting process. The shell may be formed via further dips of alternative material (e.g., in alumina, silica, and the like—again likely via suspension slurry and dry backup dips). After pattern dewax (e.g., steam autoclave after drying) and shell firing, the prime coat forms a lining of the shell/mold that contacts the poured molten alloy. During casting, the lining attracts sulfur from the cast alloy and/or prevents additional pickup of sulfur to enter the alloy. Other such prime coats include $Y_2O_3$, CaO, LaO, $ZrO_2$ or any of the rare earth element oxides discussed above. This may replace or line a baseline shell of alumina, alumino-silicate, mullite, silica or $ZrSiO_4$. The silicon in the colloidal silica slurry forms a glassy oxide upon firing to provide crushability to accommodate molten metal solidification. The colloidal silica in the slurry will provide such silicon for the layer. Thus, use of colloidal silica does not have this benefit if used in creating a similar layer on a crucible and is more likely to be replaced by an aqueous or alcohol carrier for the MgO, etc.

Other ceramic components that may be similarly modified include the snout or fill tube (16 of the '934 patent) which transfers metal from the lower melt chamber to the upper mold chamber, the ceramic (refractory) packing material that surrounds the melting crucible and induction coil (5*r* in the '934 patent already identified as MgO thus the atmospheric exposure of such a baseline may be increased (e.g., increasing surface area by making porous or by expanding the footprint) and the purity may be increased to improve gettering), the refractory material embedded between the induction coil turns (e.g., radial outward extensions of the material 5L of the '934 patent which are illustrated as metal pieces in the '934 patent), and any ceramic filters in the system. The filters may desulfurize by filtering out particles of gettering material that have acquired sulfur or by merely providing an enhanced surface area of gettering material (e.g., while potentially filtering out other solids).

Figure 7C:
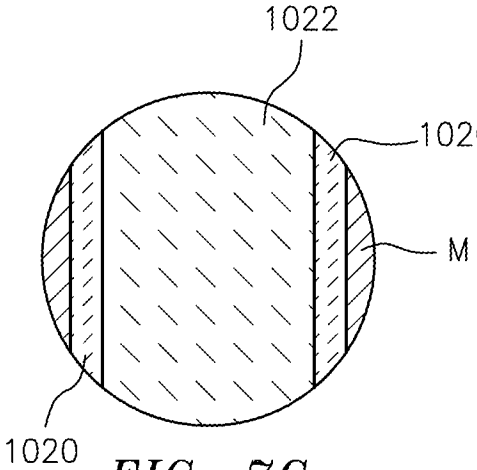
FIG. 7C is a sectional view of a sulfur-gettering layer on a snout substrate.

Thus, whereas the baseline snout may be made of silica or zirconia, a revised snout may be made of or include a layer 1020 (added FIG. 7C) of the material identified above (e.g., layer 1020 on a substrate 1022 of the baseline crucible material). Manufacture of such a snout or fill tube may be those identified above for the crucible. The material may be along the interior of the tube and/or at least the portion of the exterior that is immersed in the crucible melt.

Although the '934 patent does not mention filters, one containing the gettering material could be added (e.g., a filter 1030 (added FIG. 7B)). An exemplary filter is located in the snout or sprue nozzle and may be formed of CaO, $Y_2O_3$, LaO, $ZrO_2$, or other rare earth oxides. The filter may be made via ceramic foam or reticulated ceramic material manufacture techniques or extrusion.

Another area is adding a separate source 1040 (FIG. 7B) of the sulfur-gettering material strategically in the equipment to pick up sulfur that is generated by the equipment. For example, a powder 1050 of MgO or CaO may be added directly to the molten metal at one location, allowed to getter the sulfur for a period of time and then removed with a filter (e.g., 1030) downstream thereof. Another exemplary location for powder introduction is in the melting chamber 1 of the '934 patent. An exemplary source of the particulate may be configured as a gravity feed or simply a vacuum port such as used to feed ingots (in which a package (sacrificial nickel foil) of powder may be fed), Immersion and mechanical devices can be used to deliver the powder packet to the surface of the melting crucible or embed it deeper into the molten pool to achieve better dispersion of the gettering agent. The nickel foil may help maintain integrity of the powder until it immerses in the melt so as to reduce the amount of powder that might get sucked into vacuum pumps. Exemplary powder is fine (e.g., 300 mesh (more broadly (50 mesh to 500 mesh))). Alternatively, the particulate may be larger pellet forms which are allowed to stir in the induction melt to effectively desulfurize.

In one area of variations on the particulate introduction, rather than filtering the gettering media, sufficient vacuum levels can be reached to volatize the gettering media and the adsorbed contaminants from the molten metal.

Another area/technique is to disperse containers 1062 (FIG. 7) of gettering material 1060 such as CaO, LaO, $ZrO_2$, $Y_2O_3$ or other rare earth oxides in the mold and/or melting chamber to prevent extraneous sulfur from entering the molten metal from the surrounding environment. These may be configured as one or more trays of powder (e.g., size noted above) or larger pellets or may be in monolithic shapes (plates, tubes, rods, etc.) secured or placed within the furnace.

Another area/technique is to reduce or eliminate additional sulfur production/release within the apparatus. This may involve ensuring all pumps used to evacuate air in the metal or mold chamber are free of oil or other contaminants like grease which can contain sulfur. To effectively do this, oil-less or dry vacuum pumps can be used. There are several types of dry pumps including claw & hook pumps, screw pumps, and lobe pumps which do not use oil. This may be counterintuitive in that the pumps are used to depressurize rather than pressurize. Nevertheless, they may be a source of contamination via backstreaming. Several pumps can be combined in parallel or series. Pumps can be of a variety of types and capacities such as single stage rotary vane pumps, diaphragm pumps, oil-free scroll pumps, dry compressing multi-stage roots pumps, dry compressing screw pumps and systems, roots blower pumps, diffusion pumps and turbomolecular pumps. These come in a variety of pumping speeds and capacity to achieve desired process time (eg 1000 to 100,0001/s) and vacuum levels (e.g., $<10^{-1}$ to $10^{-7}$ mbar.)

For example, the '934 patent shows a first pumping system 23 for the melting compartment 1 as having a rotary oil-sealed vacuum pump 23*a*, a ring jet booster pump 23*b*, and a rotary vane holding pump 23*e*. Two second pumping systems 24*a* and 24*b* may evacuate the casting compartment 3 and may operate in parallel or tandem. Each includes a rotary oil-sealed vacuum pump and a Roots-type blower to provide an initial vacuum level of roughly 50 microns and below in casting compartment 3 when isolation valve 2 is closed.

An exemplary modification of the '934 patent's system involves replacing pumping systems 23, 24*a* and 24*b* each with oil-less mechanical, booster, and diffusion pumps, with oil traps.

Another area/technique is to ensure the melting and casting environments are sufficiently free of air. Oil-containing vacuum and diffusion pumps may be modified with traps. Traps include: condensation (e.g., cold) traps (e.g., baffles like chevron baffles); absorbent (so-called "room temperature") traps; and adsorbent traps. Condensation to prevent backstreaming of contaminants (e.g., oil) allows higher vacuum levels (lower amounts of air) to be achieved in that reduced contaminants mean the pumping of air competes less with pumping of contaminants. One exemplary location for such a trap is between pumps 23*a* and 23*b* of the '934 patent. Another location is between 24*a* and mold chamber 3, and at location 24*h*. Locations are dependent on the sequence and types of pumps chosen.

Reduction of sulfur generation/release would also apply to other mechanical components in the system such as hydraulic cylinders, valves, and seals where an electrical or pneumatic component could be substituted for a hydraulic. Examples in the '934 patent include hydraulic cylinders 4, 8, 14*b*, 35, 37, 72 and hydraulic actuator 14*b*. Examples in '934 patent of valves are 2, and 19*d*.

Another area/technique is to ensure there is no additional sulfur added to the apparatus through use of gases to provide the differential pressure to push the metal upward into the casting mold (countergravity). To accomplish this, special low sulfur protective gases like argon and helium should be used or the differential pressure could be created by different vacuum pressure levels without introducing additional gases. Although the '934 patent at col. 5, line 25 mentions argon, extra care could be taken to ensure extremely low sulfur levels in the argon or other gas and extreme lack of moisture (which moisture might produce oxygen to react with materials such as graphite and aerate any sulfur that was contained in the graphite).

Another area/technique is to change the sequence of the typical casting process to purify the metal. The current countergravity casting method relies on differential pressure to push the molten metal upward into the casting mold, holding for a short period of time until the castings and ingots are solid, and then releases pressure to dump the unsolidified metal within the snout or fill tube to fall back down into the melting crucible for reuse. This practice exposes the molten metal to mold material and environments that could allow sulfur pickup which would lead to contaminating the low sulfur metal contained in the melting crucible. To prevent sulfur pickup, the metal can be held for a longer period of time to solidify the metal in the snout. In this case, the snout could not be reused but the remaining molten metal in the crucible would not be contaminated. The snout would become a consumable item replaced with each use.

Details of the '934 patent as an example of one baseline are given below.

FIG. 1 shows a floor level front view of apparatus, with certain components shown in section for purposes of illustration, for practicing an embodiment of the process for melting and countergravity casting nickel, cobalt and iron base superalloys for purposes of illustration and not limitation. For example, the melting chamber 1 and shaft 4*d* are shown in section for purposes of illustration. The process is not limited to melting and casting of these particular alloys and can be used to melt and countergravity cast a wide variety of metals and alloys where it is desirable to control exposure of the metal or alloy in the molten state to oxygen and/or nitrogen.

A melting chamber or compartment 1 is connected by a primary isolation valve 2, such as a sliding gate valve, to a casting chamber or compartment 3. The melting compartment 1 comprises a double-walled, water-cooled construction with both walls made of stainless steel. Casting compartment 3 is a mild steel, single wall construction. Shown adjacent to the melting compartment 1 is a melting vessel location control cylinder 4 which moves hollow shaft 4*d* connected to a shunted melting vessel 5 horizontally from the melting compartment 1 into the casting compartment 3 along a pair of tracks 6 (one track shown) that extend from the compartment 1 to the compartment 3.

The melting vessel 5 is disposed on a trolley 5*t* having front, middle, and rear pairs of wheels 5*w* that ride on the tracks 6. The steel frame of the trolley 5*t* is bolted to the melting vessel and to the end of shaft 4*d*. The tracks 6 are interrupted at the isolation valve 2. The interruption in the tracks 6 is narrow enough that the trolley 5*t* can travel over the interruption in the tracks 6 at the isolation valve 2 as it moves between the compartments 1 and 3 without simultaneously disengaging more than one pair of the wheels 5*w*.

The control cylinder 4 includes a cylinder chamber 4*a* fixed to apparatus steel frame F at location L and a cylinder rod 4*b* connected to a wheeled platform structure 4*c* that includes front and rear, upper and lower pairs of wheels 4*w* that ride on a pair of parallel rails 4*r*1 above and below the rails, FIGS. 1A and 3. The rails 4*r*1 are located at a level or height corresponding generally to that of shaft 4*d*. In FIG. 1, the rear rail 4*r*1 (nearer power supply 21 shown in FIG. 3) is hidden behind the shaft 4*d* and the front rail 4*r*1 is omitted to reveal the shaft 4*d*. Wheels 4*w* and rail 4*r*1 are shown in FIG. 1A. Hollow shaft 4*d* is slidably and rotatably mounted by a bushing 4*e* at one end of the platform structure 4*c* and by a vacuum-tight bushing 4*f* at the other end in an opening in the dish-shaped end wall 1*a* of melting compartment 1. Linear sliding motion of the hollow shaft 4*d* is imparted by the drive cylinder 4 to move the structure 4*c* on rails 4*r*1.

When the melting compartment 1 has been opened by a hydraulic cylinder 8 powering opening of the dish-shaped end wall 1*a* of the melting compartment to ambient atmosphere, the melting vessel 5 can be disengaged from the trolley tracks 6 and inverted or rotated by a direct drive electric motor and gear drive system 7 disposed on platform structure 4*c*. The rotational electric motor and gear drive system 7 includes a gear 7*a* that drives a gear 7*b* on the hollow shaft 4*d* to effect rotation thereof. Electrical control of the direct drive motor is provided from a hand-held pendent (not shown) by a worker/operator. The melting vessel 5 can be inverted or rotated as necessary to clean, repair or replace the crucible C therein, FIG. 4, or to pour excess molten metallic material from the melting vessel at the end of a casting campaign into a receptacle (not shown) positioned below the crucible.

Figure 4:
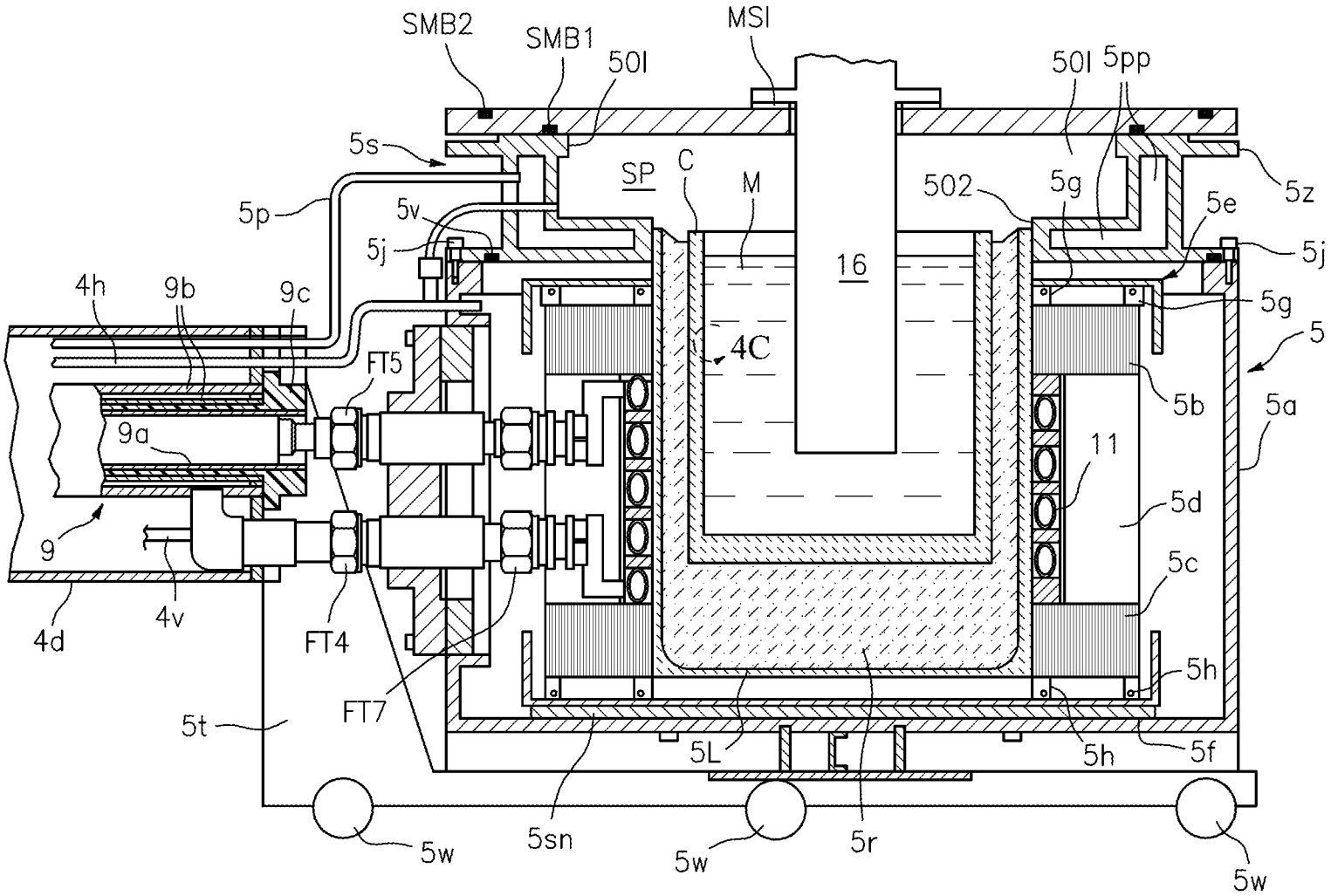
FIG. 4 is a sectional view of the melting vessel taken along the centerline of the shaft with some elements shown in elevation.
Figure 4A:
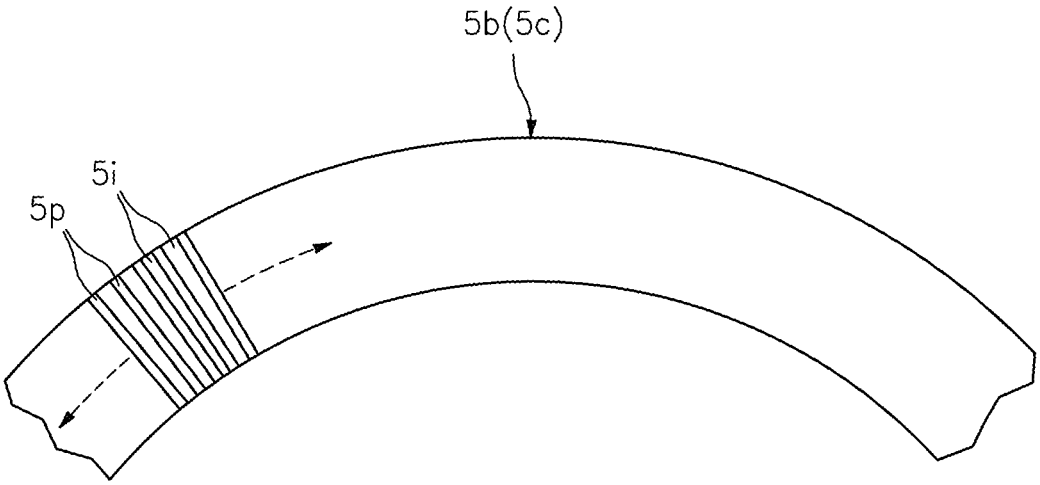
FIGS. 4A and 4B are partial enlarged elevational views of the horizontal shunt ring and a vertical shunt tie-rod member.
Figure 4B:
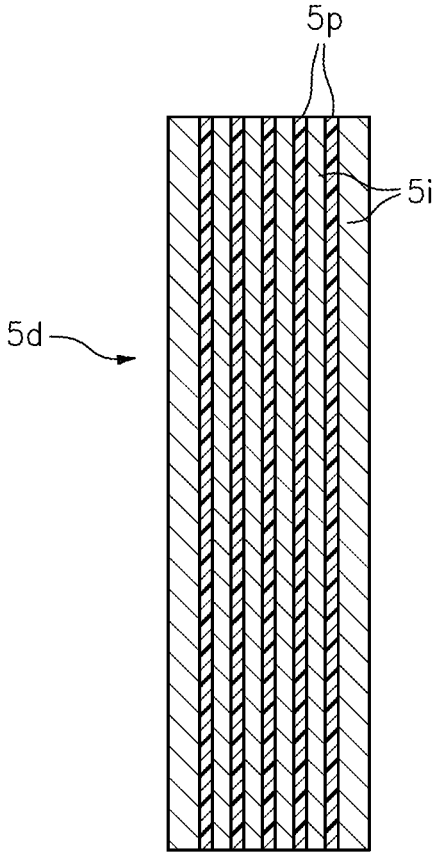
Figure 4C:
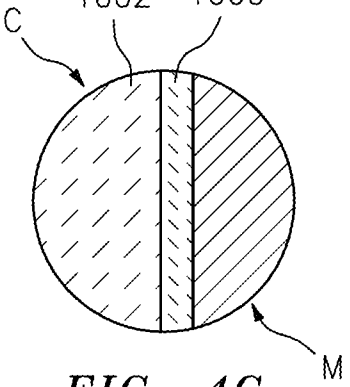
FIG. 4C is a sectional view showing a sulfur-gettering layer on a melting crucible substrate.

FIGS. 1 and 4 show that hollow shaft 4*d* contains electrical power leads 9 which carry electrical power from a power supply 21 to the melting vessel 5, which contains a water cooled induction coil 11 shown in FIG. 4 in melting vessel 5. The leads 9 are spaced from the hollow shaft 4*d* by electrical insulating spacers 38. Shown in more detail in FIG. 4, the power leads 9 comprise a cylindrical tubular water-cooled inner lead tube 9*a* and an annular outer, hollow, double-walled water-cooled lead tube 9*b* separated by electrical insulating material 9*c*, such as G10 polymer or phenolic, both at the end and along the space between the lead tubes. A cooling water supply passage is defined in the hollow inner lead tube 9*a* and a water return passage is defined in the outer, double-walled lead tube 9*b* to provide both supply and return of cooling water to the induction coil 11 in the melting vessel 5. Returning to FIG. 1, electrical power and water are provided, and exhausted as well, to the power leads 9*a*, 9*b* through flexible water-cooled power cables 39, connected to the outer end of hollow shaft 4*d* and to a bus bar 9*d* to accommodate its motion during operation. The power supply 21 is connected by these power cables to external fittings FT1, FT2 connected to each power lead tube 9*a*, 9*b* at the end of the shaft 4*d*. The electrical power supply includes a three-phase 60 Hz AC power supply that is converted to DC power for supply to the coil 11. The electric motor 7*c* that rotates shaft 4*d* receives electrical power from a flexible power cable (not shown) to accommodate motion of the shaft 4*d*.

Figure 13:
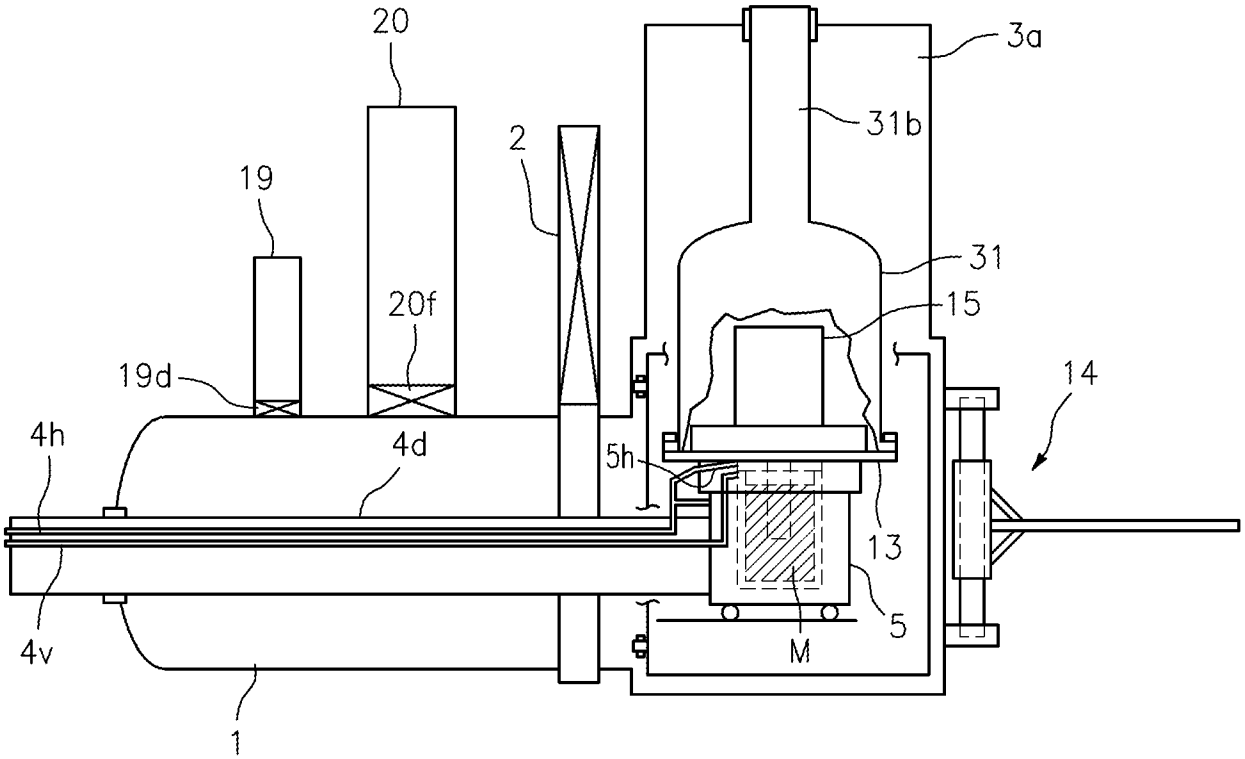

A gas pressurization conduit 4*h*, FIGS. 4 and 13, also is contained in the hollow shaft 4*d* and is connected by a fitting on the end of shaft 4*d* to a source S of pressurized gas, such as a bulk storage tank of argon or other gas that is non-reactive with the metallic material melted in the vessel 5. The conduit 4*h* is connected to the source S through a gas control valve VA by a flexible gas supply hose H1 to accommodate motion of shaft 4*d*. A vacuum conduit 4*v*, FIGS. 4 and 13, also is contained in the hollow shaft 4*d*. Vacuum conduit 4*v* is connected by a fitting on the end of shaft 4*d* to vacuum pumping system 23*a*, 23*b*, and 23*c* via a valve VV and flexible hose H2 at the end of the shaft 4*d* to accommodate motion of shaft 4*d*. The vacuum pumping system 23*a*, 23*b*, and 23*c*, evacuates the melting compartment 1 as described below.

As mentioned above, rotational motion of the melting vessel 5 is provided by direct drive electric motor 7*c* and gears 7*a*, 7*b* of drive system 7 that may be activated when the melting compartment 1 has been opened by the hydraulic cylinder 8 powering such opening. In particular, the cylinder chamber 8*a* is affixed to a pair of parallel rails 8*r* that are firmly mounted to the floor. The cylinder rod 8*b* connects to the rail-mounted movable apparatus frame F at F1 where it connects to the dish-shaped end wall 1*a* of the melting compartment 1. The melting compartment end wall 1*a* can be moved by cylinder 8 horizontally away from main melting compartment wall 1*b* at a vacuum-tight seal 1*c* after clamps 1*d* are released to provide access to the melting compartment; for example, to clean or replace the crucible C in the melting vessel 5. The seal 1*c* remains on melting compartment wall 1*b*. The support frame F and end wall 1*a* are supported by front and rear pairs of wheels 8*w* on parallel rails 8*r* during movement by cylinder 8.

Figure 3:
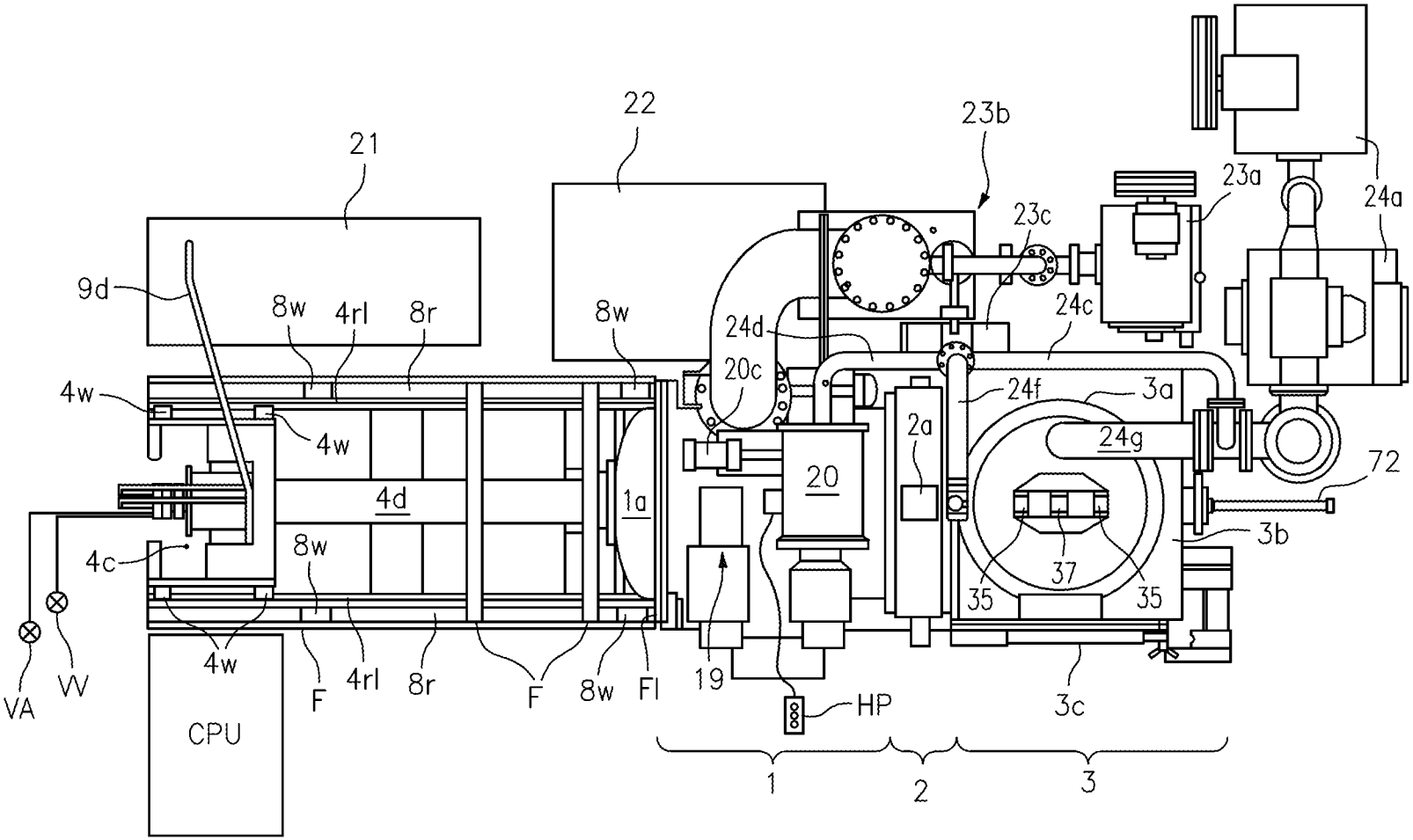
FIG. 3 is a plan view of the apparatus of FIG. 1.

A conventional hydraulic unit 22 is shown in FIGS. 1 and 3 and provides power to all hydraulic elements of the apparatus. The hydraulic unit 22 is located alongside the melting compartment 1.

In FIG. 1, conventional vacuum pumping systems 24*a* and 24*b* are shown for evacuating the casting compartment 3 and, as required, all other portions of the apparatus to be described below with the exception of the melting chamber 1. The melting compartment 1 is evacuated by separate conventional vacuum pumping system 23*a*, 23*b* and 23*c* shown in FIG. 3. Operation of the apparatus is controlled by a combination of a conventional operator data control interface, a data storage control unit, and an overall apparatus operating logic and control system represented schematically by CPU in FIG. 3.

The vacuum pumping system 23 for the melting compartment 1 comprises three commercially available pumps to achieve desired negative (subambient) pressure; namely, a Stokes 412 microvac rotary oil-sealed vacuum pump 23*a*, a ring jet booster pump 23*b*, and a rotary vane holding pump 23*c* operated to provide vacuum level of 50 microns and below (e.g. 10 microns or less) in melting compartment 1 when isolation valve 2 is closed.

Figure 5:
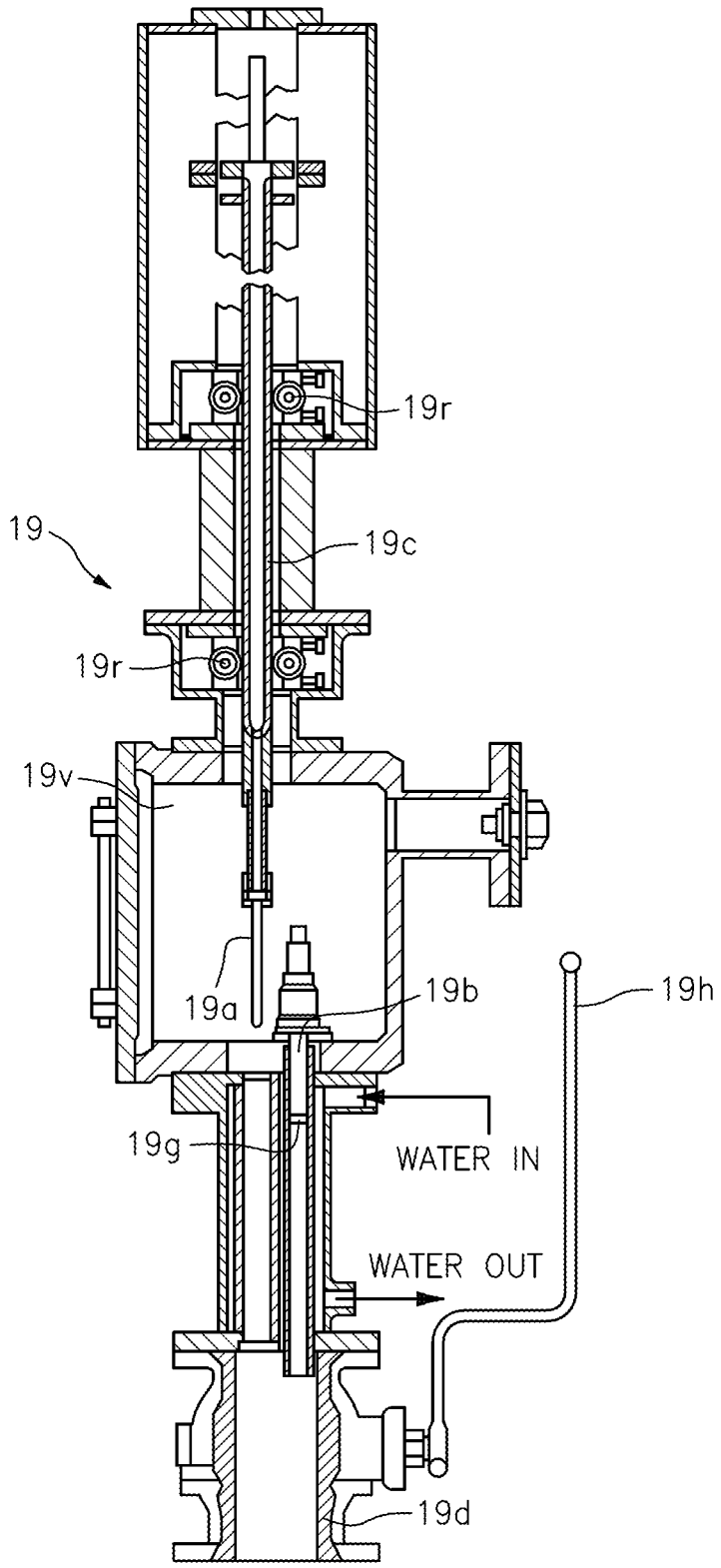
FIG. 5 is a longitudinal sectional view of the temperature measurement and control device to illustrate certain internal components shown in elevation.

A temperature measurement and control instrumentation device 19 is provided at the melting compartment 1, FIGS. 1 and 5, and comprises a multi-function device including a movable immersion thermocouple 19*a* for temperature measurement with maximum accuracy, combined with a stationary single color optical pyrometer 19*b* for temperature measurement with maximum ease and speed. The immersion thermocouple is mounted on a motor driven shaft 19*c* to lower the thermocouple into the molten metallic material in the crucible C when isolation valve 19*d* is opened to communicate to melting chamber 1. The shaft 19*c* is driven by electric motor 19*m*, FIG. 1, with its movement guided by guide rollers 19*r*. The thermocouple and pyrometer are combined in a single sensing unit to permit simultaneous measurement of metal temperature by both the optical and immersion thermocouple. The optical pyrometer is a single color system that measures temperature in the range of 1800 to 3200 degrees F. Because relatively minor issues such as a dirty sight glass impact the accuracy of optical readings, frequent calibration against immersion thermocouple readings is highly advisable for good process control. The thermocouple and pyrometer provide temperature signals to the CPU. A vacuum isolation chamber 19*v* can be opened after isolation valve 19*d* is closed by handle 19*h* to permit access for replacement of the immersion thermocouple tip and cleaning of the optical pyrometer sight glass 19*g* without breaking vacuum in the melting chamber 1. The envelope around the optical pyrometer is water cooled for maximum sensitivity and accuracy of temperature measurement. The melting vessel 5 is maintained directly below the device 19 to monitor and control the melt temperature during melting.

Figure 6:
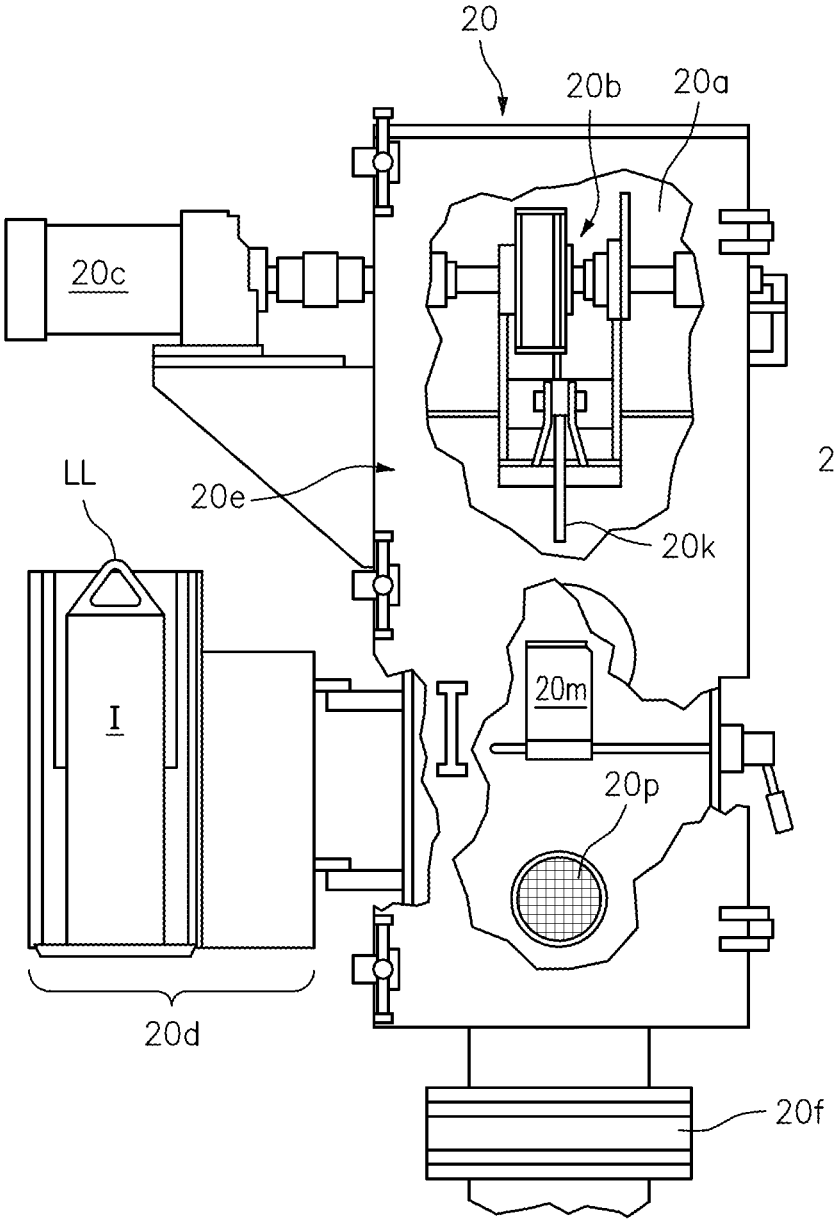
FIG. 6 is an elevational view, partially broken away, of the ingot charging system.
Figure 6A:
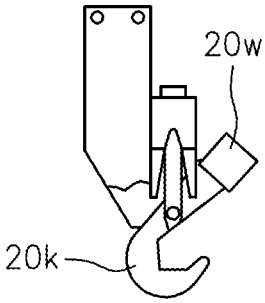
FIG. 6A is a partial elevational view of the hook.
Figure 8:
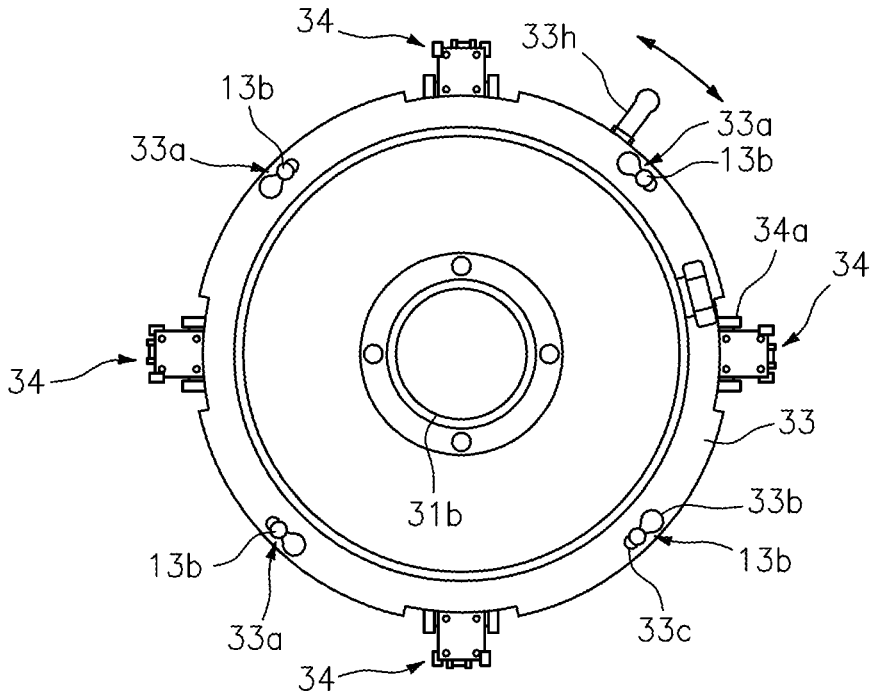
FIG. 8 is a plan view of the mold bonnet clamped on the mold base.

An ingot charging device 20 is illustrated in FIGS. 1 and 6, and 6A and is communicated to the melting compartment 1. This device is designed to permit simple and rapid introduction of additional metallic material (e.g. metal alloy) in the form of individual ingots I to the molten metallic material in the melting vessel 5 without the need to break vacuum in the melting chamber 1. This saves substantial time and avoids repeated exposure of the hot metal remaining in the crucible to contamination by either the oxygen or the nitrogen in the atmosphere. The device comprises a chamber 20*a*, chain hoist 20*b* driven by an electric motor 20*c* controlled by pendent operator hand control HP (FIG. 3), an ingot-loading assembly 20*d* hinged on the left side of the device in FIG. 6. Also shown are a door 20*e* hinged on the right side of the device and shown closed with cut away views, and an isolation valve 20*f* (called a load valve) which isolates or communicates the ingot feeder device to the melt chamber 1. With the load valve 20*f* closed, the pressure in chamber 20*a* can be brought up to atmospheric pressure so that the door 20*e* can be opened.

When the melt vessel 5 is ready to be charged, a preheated ingot I (preheated to remove any moisture from the ingot) is loaded onto the ingot-loading assembly 20*d*. The ingot-loading assembly 20*d* is then swung into the chamber 20*a*. The chain hoist 20*b* is lowered into position so that hook 20*k* engages ingot loop LL. The hoist 20*b* is then raised to take the ingot I off from ingot-loading assembly 20*d*. The ingot-loading assembly 20*d* is swung out of the chamber 20*a*. The door 20*e* then is closed and sealed. At this point, vacuum is applied to the chamber 20*a* by vacuum pumping system 24*a* and 24*b* via vacuum conduits 24*c* and 24*d* (FIG. 3) connected to vacuum port 20*p* to bring the pressure down to the same vacuum as in the melt chamber or compartment 1. The load valve 20*f* then is opened to provide communication to the melting vessel 5 and the hoist 20*b* is lowered by motor 20*c* until the ingot I is just above crucible C in the melting vessel 5.

The hoist speed is then slowed down so that the ingot is preheated as it is lowered into the crucible C. When the ingot is in the crucible, the weight is automatically released from the chain hoist hook 20*k* by upward pressure from the crucible or molten metallic material in the crucible. A counterweight 20*w* on the hook 20*k*, FIG. 6A, causes the hook to be removed from the ingot I.

The hoist 20*b* is then raised and the load valve 20*f* is closed. The procedure is repeated to charge additional individual ingots into the melting vessel until the crucible C is fully charged. A sight-glass 20*g*, FIG. 1, cooperating with a mirror 20*m* permit viewing of the crucible to determine if it is properly charged.

When the melting vessel 5 has been pulled out of the melt chamber 1 for crucible cleaning, a full load of ingots can be placed in the crucible C before the melting vessel 5 is returned to the melt chamber 1. This eliminates the need to charge ingots one at a time for the first charge. After the melting vessel 5 is charged with ingots at the ingot charging device 20, it is moved to the instrumentation device 19 where the ingots are melted by energization of the induction coil 11.

Referring to FIG. 4, the melting vessel 5 includes a steel cylindrical shell 5*a* in which the water cooled, hollow copper induction coil 11 is received. The coil 11 is connected to leads 9*a*, 9*b* by threaded fittings FT5, FT6; and FT4, FT7. The coil 11 is shunted by upper and lower horizontal shunt rings 5*b*, 5*c* connected by a plurality (e.g. six) of vertical shunt tie-rod members 5*d* spaced apart in a circumferential direction between the upper and lower shunt rings 5*b*, 5*c* to concentrate the magnetic flux near the coil and prevent the transfer of the induction power to surrounding steel shell 5*a*. The tie rod members 5*d* are connected to the upper and lower shunt rings 5*b*, 5*c* by threaded rods (not shown). Upper and lower coil compression rings 5*e*, 5*f* and pairs of spacer rings 5*g*, 5*h* are provided above and below the respective shunt rings 5*b*, 5*c* for mechanical assembly.

The shunt rings 5*b*, 5*c* and tie-rod members 5*d* comprise a plurality of alternate iron laminations 5*i* and phenolic resin insulating laminations 5*p* to this end. A flux shield 5*sh* made of electrical insulating material is disposed beneath the lower-shunt ring 5*c*.

A closed end cylindrical (or other shape) ceramic crucible C is disposed in the steel shell 5*a* in a bed of refractory material 5*r* that is located inwardly of the induction coil 11. The ceramic crucible C can comprise an alumina or a zirconia ceramic crucible when nickel base superalloys are being melted and cast. Other ceramic crucible materials can be used depending upon the metal or alloy being melted and cast. The crucible C can be formed by cold pressing ceramic powders and firing.

The crucible is positioned in bed 5*r* of loose, binderless refractory particles, such as magnesium oxide ceramic particles of roughly 200 mesh size. The bed 5*r* of loose refractory particles is contained in a thin-wall resin-bonded refractory particulate coil grouting 51, such as resin-bonded alumina-silica ceramic particles of roughly 60 mesh size, that is disposed adjacent the induction coil 11, FIG. 4.

The resin-bonded liner 51 is formed by hand application and drying, and then the loose refractory particulates of bed 5*r* are introduced to the bottom of the liner 51. The crucible C then is placed on the bottom loose refractory particulates and the space between the vertical sidewall of the crucible C and the vertical sidewall of the liner 51 is filled in with loose refractory particulates of bed 5*r*.

An annular gas pressurization chamber-forming member 5*s* is fastened by suitable circumferentially spaced apart fasteners 5*j* and annular seal 5*v* atop the shell 5*a*. The member 5*s* includes an upper circumferential flange 5*z*, a large diameter circular central opening 501 and a lower smaller diameter circular opening 502 adjacent the upper open end of the crucible C and defining a central space SP. Water cooling passages 5*pp* are provided in the member 5*s*, which is made of stainless steel. The water cooling passages 5*pp* receive cooling water from water piping 5*p* contained within the hollow shaft 4*d*. The return water runs through a similar second water piping (not shown) located directly behind piping 5*p*.

Gas pressurization conduit 4*h* extends to the melting vessel 5 and is communicated to the central space SP of the member 5*s* and to the space around the outside of the melting induction coil 11 to avoid creation of a different pressure across the crucible C. Similarly, vacuum conduit 4*v* extends to the melting vessel 5 and is communicated to the central space SP of the member 5*s* and to the space around the outside of the melting induction coil 11 in a manner similar to that shown for conduit 4*h* in FIG. 4.

In practice of the process, after the melting vessel 5 is charged with ingots at the ingot charging device 20, it is moved to the instrumentation device 19 where the ingots are melted in the melting compartment 1 under a full vacuum (e.g. 10 microns or less) by energization of the induction coil 11 to this end to form a bath of molten metallic material M in the crucible C. The vacuum conduit 4*v*, FIG. 4, and valve VV, FIGS. 1 and 3, are controlled to provide the vacuum in space SP and in the space around the outside of the induction coil 11 of the melting vessel 5 during melting.

When the ingots have been melted in the melting vessel 5, a preheated ceramic mold 15 is loaded into casting chamber or compartment 3 isolated by valve 2 from the melting compartment 1. The casting compartment 3 comprises an upper chamber 3*a* and lower chamber 3*b* having a loading/unloading sealable door 3*c*, FIG. 2. The lower chamber also includes a horizontally pivoting mold base support 14. The mold base support 14 comprises a vertical shaft 14*a* and a hydraulic actuator 14*b* on the shaft 14*a* for moving up and down and pivoting motion thereon. The shaft 14*a* is supported between upper and lower triangular plates 14*p* welded to a fixed apparatus frame and the side of the casting compartment 3. A support arm 14*c* extends from the actuator 14*b* and is configured as a fork shape to engage and carry a mold base 13.

Figure 2:
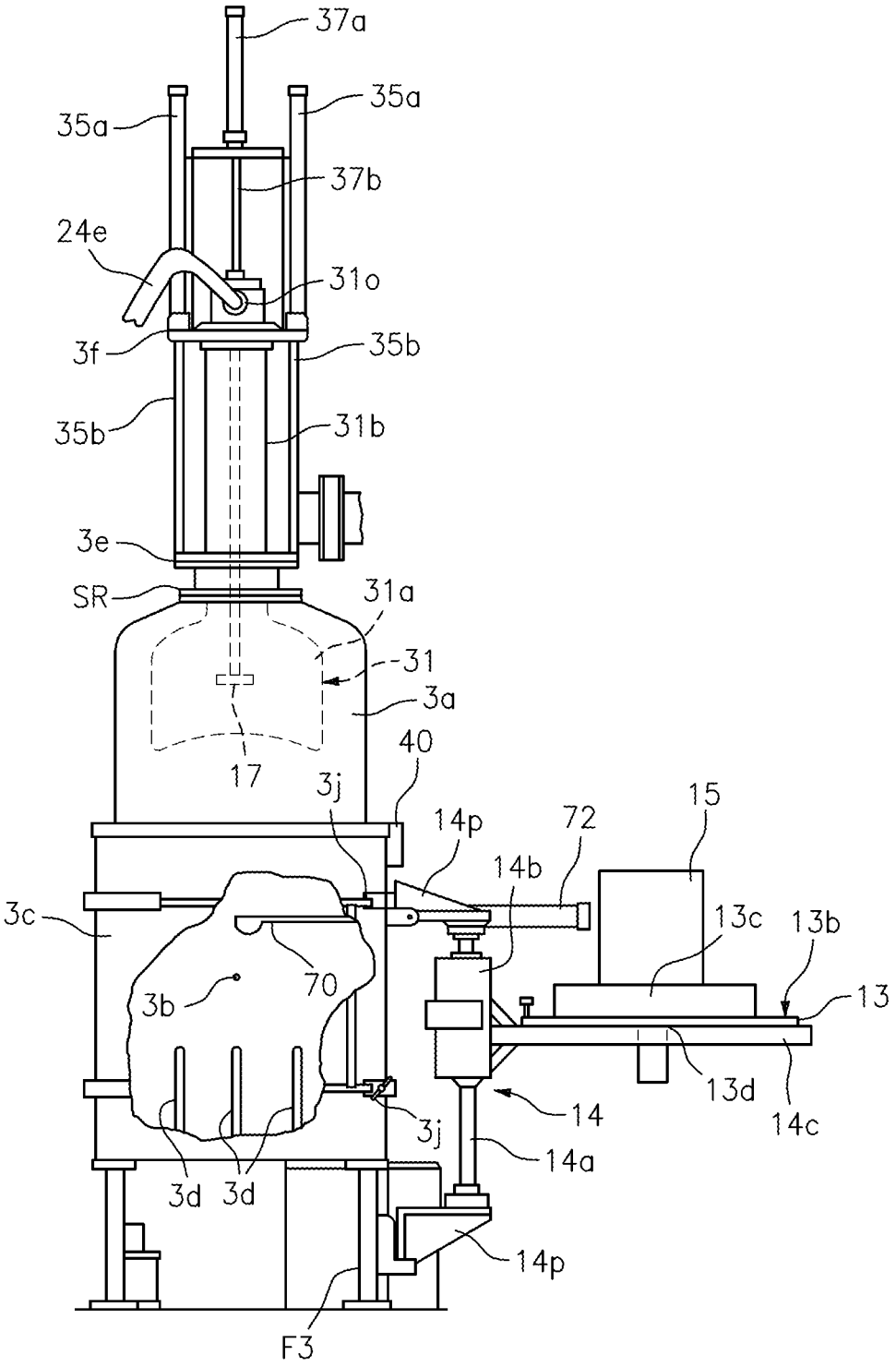
FIG. 2 is a partial elevational view of the casting compartment of FIG. 1.
Figure 7:
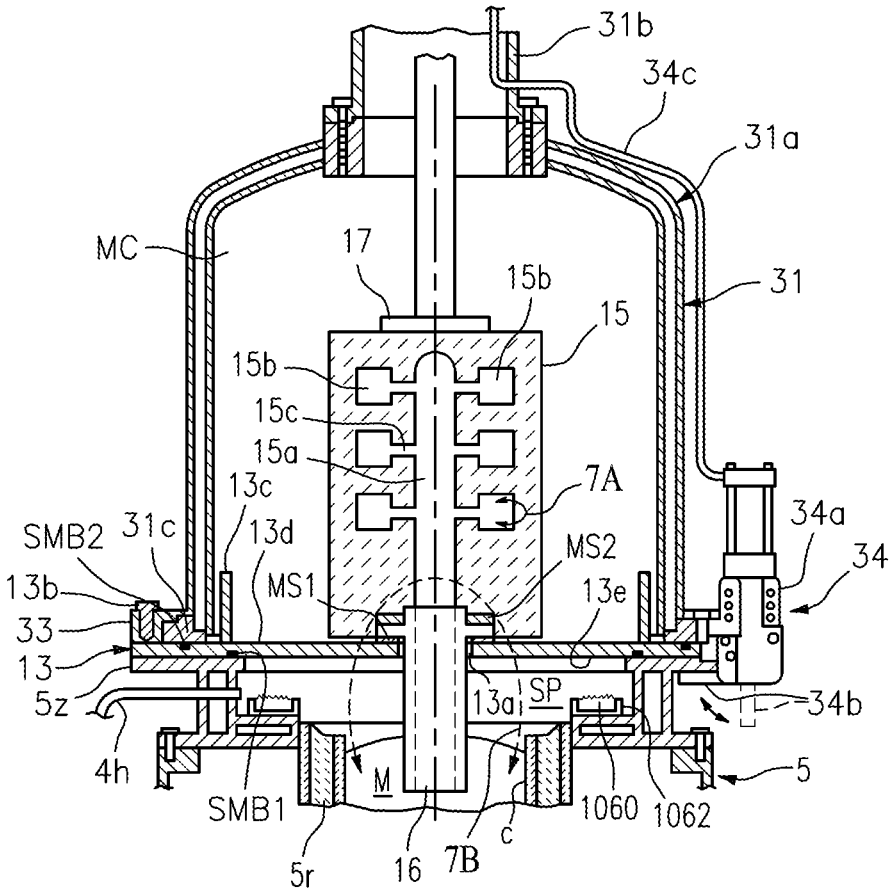
FIG. 7 is a diametral sectional view of mold bonnet on the mold base clamped on the melting vessel with certain components shown in elevation.

The mold base 13, FIGS. 2 and 7, comprises a flat plate having a central opening 13*a* therethrough. The mold base 13 includes a plurality (e.g. 4) of vertical socket head shoulder locking screws 13*b* shown in FIGS. 2, 7, 8, 9B, and 9D, circumferentially spaced 90 degrees apart on the upwardly facing plate surface for purposes to be described. The mold base includes an annular short, upstanding stub wall 13*c* on upper surface 13*d* to form a containment chamber that collects molten metallic material that may leak from a cracked mold 15, FIG. 7.

An annular seal SMB1 comprising seal means is disposed between the mold base 13 and the flange 5*z* of the melting vessel 5. The seal is adapted to be sealed between the mold base 13 and the flange 5*z* of the melting vessel 5 to provide a gas tight-seal when the mold base 13 and melting vessel 5 are engaged as described below. One or multiple seals SMB1 can be provided between the mold base 13 and melting vessel 5 to this end. The mold base seal SMB1 can comprise a silicone material. The seal SMB1 typically is disposed on the lower surface 13*e* of the mold base 13 so that it is compressed when the mold base and melting vessel are engaged, although the seal SMB1 can alternately, or in addition, be disposed on the flange 5*z* of the melting vessel 5. A similar seal SMB2 is provided on the lower end flange 31*c* of a mold bonnet 31, and/or upper surface 13*d* of mold base 13, to provide a gas-tight seal between the mold base 13 and mold bonnet 31.

The mold base 13 is adapted to receive a preheated mold-to-base ceramic fiber seal or gasket MS1 about the opening 13*a* and a preheated ceramic mold 15 and a preheated snout or fill tube 16. The preheated mold 15 with fill tube 16 is positioned on the mold base 13 with the fill tube 16 extending through the opening 13*a* beyond the lowermost surface 13*e* of the mold base 13 and with the bottom of the mold 15 sitting on a second seal MS2, a ceramic fiber gasket which seals the mold 15 and the fill tube 16.

The ceramic mold 15 can be gas permeable or gas impermeable. A gas permeable mold can be formed by the well-known lost wax process where a wax or other fugitive pattern is repeatedly dipped in a slurry of fine ceramic powder in water or organic carrier, drained of excess slurry, and then stuccoed or sanded with coarser ceramic particles to build up a gas permeable shell mold of suitable wall thickness on the pattern. A gas impermeable mold 15 can be formed using solid mold materials, or by the use in the lost wax process of finer ceramic particles in the slurries and/or the stuccoes to form a shell mold of such dense wall structure as to be essentially gas impermeable. In the lost wax process, the pattern is selectively removed from the shell mold by conventional thermal pattern removal operation such as flash dewaxing by heating, dissolution or other known pattern removal techniques. The green shell mold then can be fired at elevated temperature to develop mold strength for casting.

In practicing the process, the ceramic mold 15 typically is formed to have a central sprue 15*a* that communicates to the fill tube 16 and supplies molten metallic material to a plurality of mold cavities 15*b* via side gates 15*c* arranged about the sprue 15*a* along its length as shown in U.S. Pat. Nos. 3,863,706 and 3,900,064, the teachings of which are incorporated herein by reference.

The support arm 14*c* loaded with mold base 13 and mold 15 thereon is pivoted into chamber 3 with the access door 3*c* open and is placed on support posts 3*d* fixed to the floor of the lower chamber 3*b*, FIG. 2.

Figure 9C:
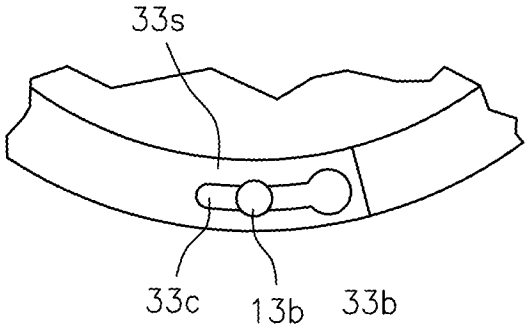
FIG. 9C is a partial plan view of the clamp ring on the mold bonnet in a clamped position.
Figure 9D:
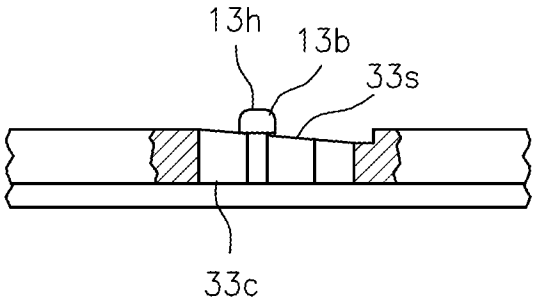
FIG. 9D is a partial elevational view, partially in section, of the clamp ring on the mold bonnet in the clamped position.
Figure 9A:
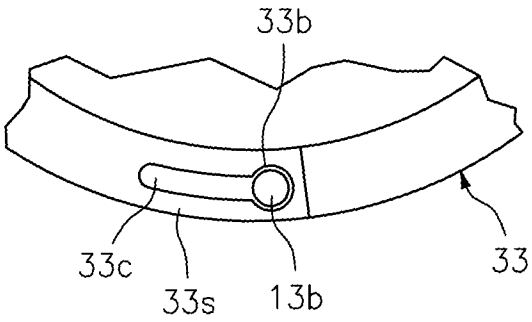
FIG. 9A is a partial plan view of the clamp ring on the mold bonnet in an unclamped position.
Figure 9B:
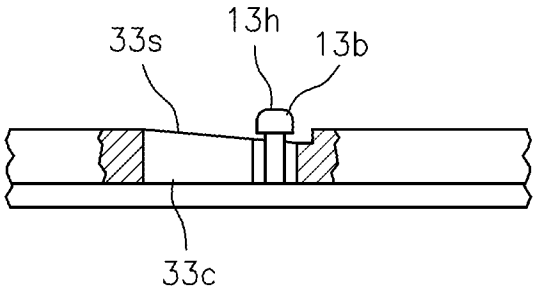
FIG. 9B is a partial elevational view, partially in section, of the clamp ring on the mold bonnet in the unclamped position.
Figure 10:
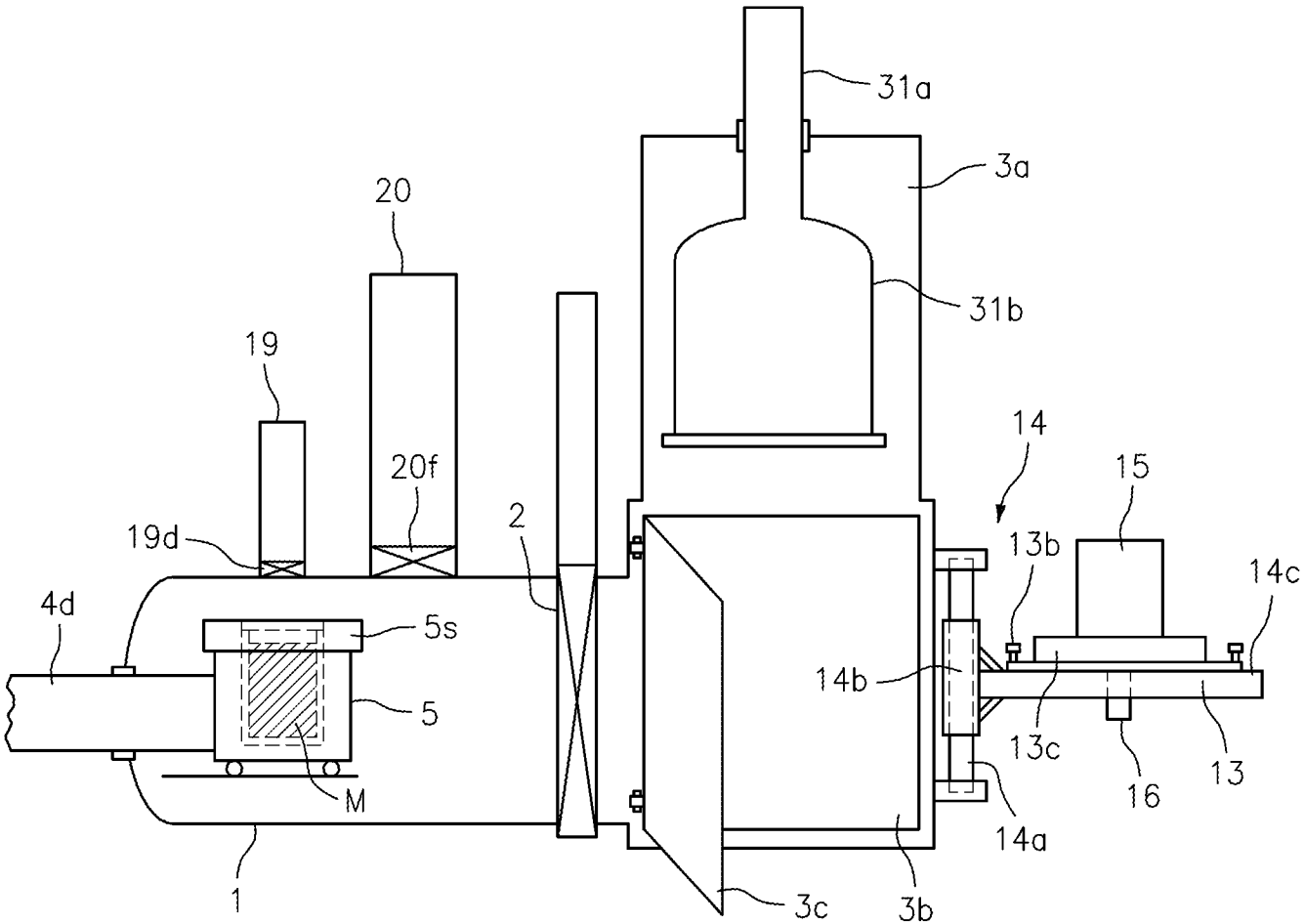
FIGS. 10, 11, 12, 13, and 14 are schematic views of the apparatus showing successive method steps for casting.
Figure 11:
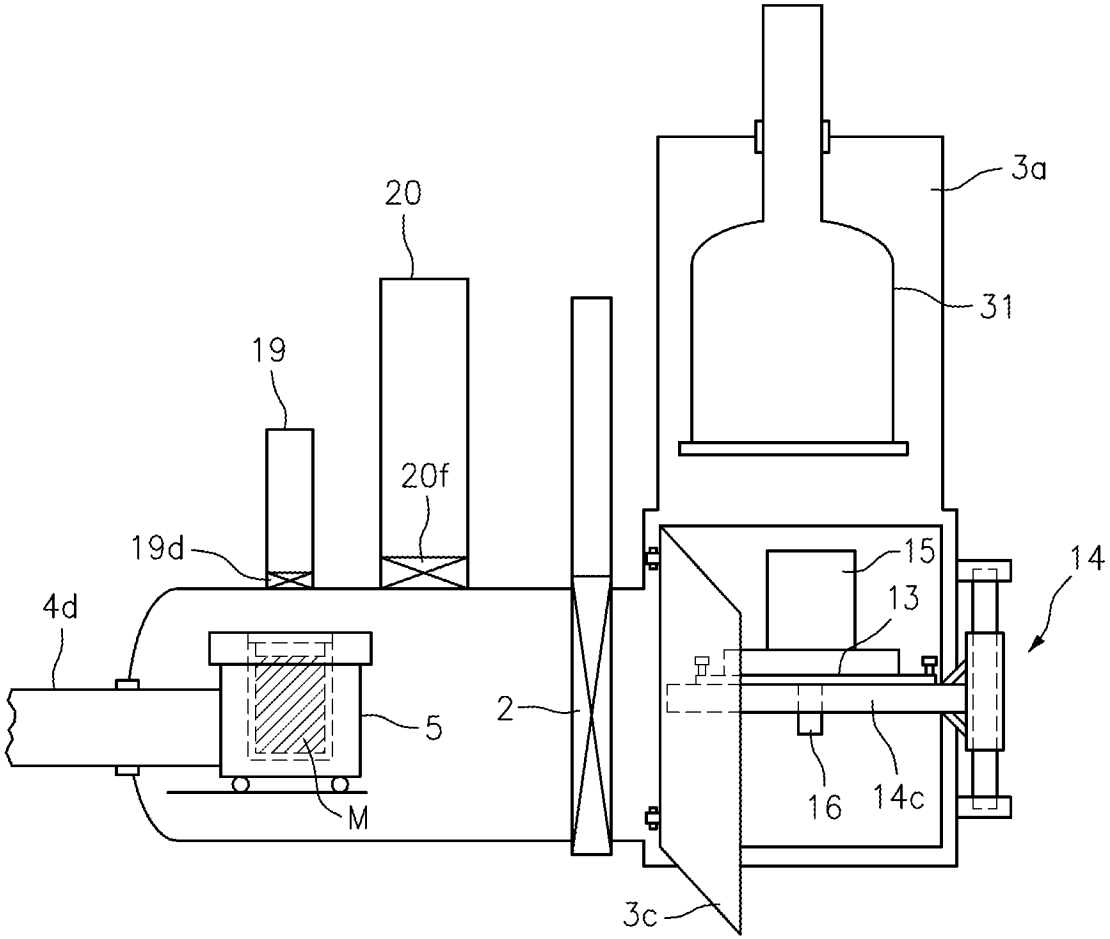
Figure 12:
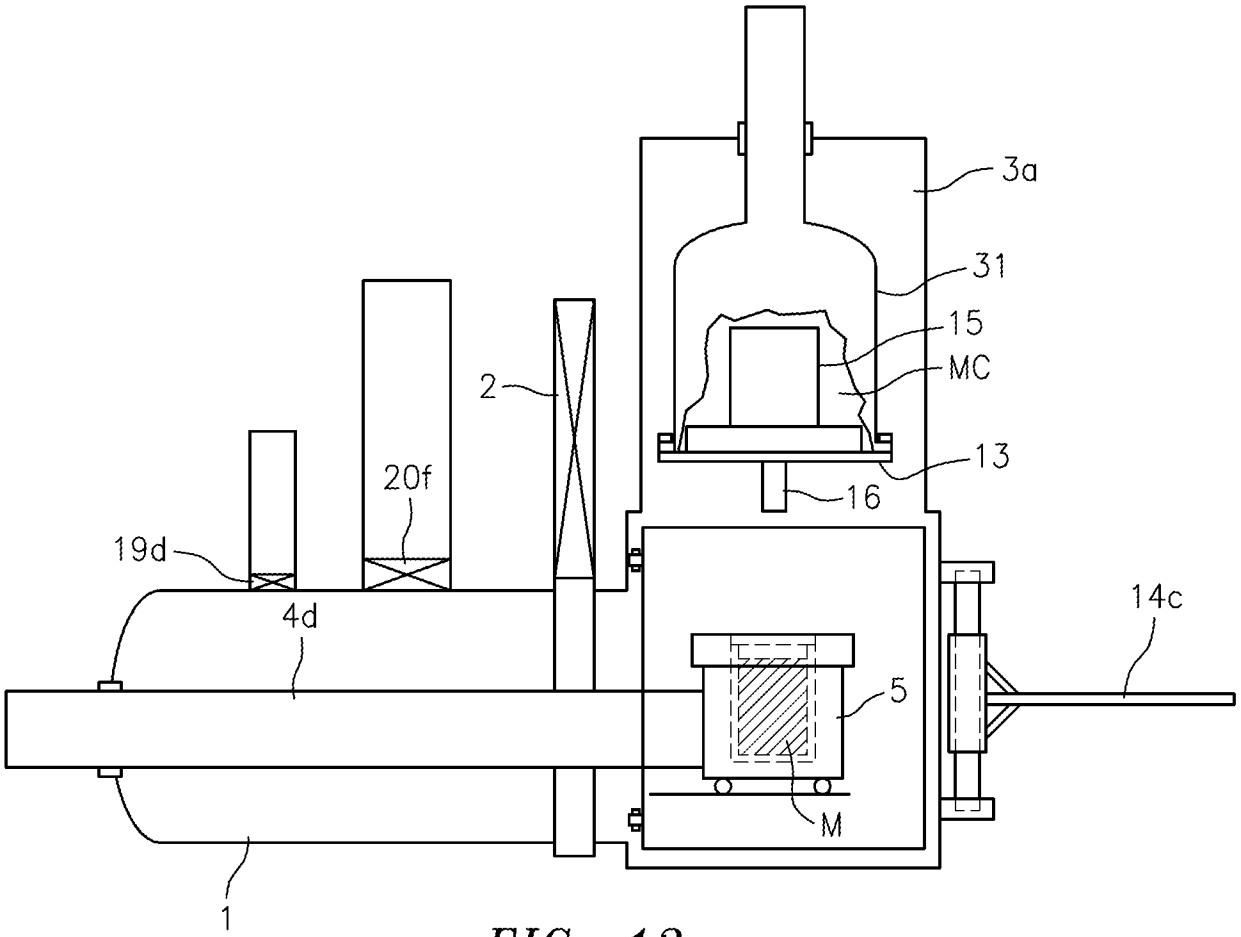

In the upper chamber 3*a* of the casting compartment is a double-walled, water cooled mold hood or bonnet 31 that is lowered onto the mold base 13 about the mold 15, FIG. 7. The mold bonnet 31 includes a lower bell-shaped region 31*a* that surrounds the mold 15 and an upper cylindrical tubular extension 31*b*, which passes through a vacuum-tight bushing SR to permit vertical movement of the bonnet 31. The lower region 31*a* includes lowermost circumferential end flange 31*c* adapted to mate with the mold base 13 with the seal SMB2 compressed therebetween to form a gas-tight seal, FIG. 7. The flange 31*c* includes a rotatable mold clamp ring 33 that has a plurality of arcuate slots 33*a* each with an enlarged entrance opening 33*b* and narrower arcuate slot region 33*c*. A cam surface 33*s* is provided on the clamp ring proximate each slot 33*a*. The mold clamp ring 33 is rotated by a handle 33*h* by the worker loading the combination of mold base 13/mold 15 into the casting compartment 3. In particular, the mold bonnet 31 is lowered onto mold base 13 such that locking screws 13*b* are received in the enlarged opening 33*a*, FIGS. 9A, 9B. Then, the worker rotates the ring 33 relative to the mold base 13 to engage cam surfaces 33*s* and the undersides of the heads 13*h* of locking screws 13*b*, FIGS. 9C, 9D, to cam lock mold base 13 against the bottom of mold bonnet 31.

The flange 31*c* has fastened thereto a plurality (e.g. 4) of circumferentially spaced apart, commercially available argon-actuated toggle lock clamps 34 (available as clamp model No. 895 from DE-STA-CO) that are actuated to clamp the melting vessel 5 and mold base 13 together during countergravity casting in a manner described below. The toggle lock clamps 34 receive argon from a source outside compartment 3 via a common conduit 34*c* that extends in hollow extension 31*b*, FIG. 7, and that supplies argon to a respective supply conduit (not shown) to each clamp 34. The toggle lock clamps include a housing 34*a* mounted by fasteners on the flange 31*c* and pivotable lock member 34*b* that engages the underside of circumferential flange 5*z* of the gas-pressurization. chamber-forming member 5*s*, FIG. 7 to clamp the melting vessel 5, mold base 13 and mold bonnet 31 together with seal SMB1 compressed between flange 5*z* and mold base 13 to provide a vacuum tight seal.

The hollow extension 31*b* of the mold bonnet 31 is connected to a pair of hydraulic cylinders 35 in a manner permitting the mold bonnet 31 to move up and down relative to the casting compartment 3. The hydraulic cylinder rods 35*b* are mounted on a stationary mounting flange 3*e* of chamber 3. The cylinder chambers 35*a* connect to the mold bonnet extension 31*b* at the flange 3*f*, which moves vertically with the actuation of the cylinders and raises or lowers the mold bonnet. The mold bonnet extension 31*b* moves through a vacuum-tight seal SR relative to the casting compartment 3.

A hydraulic cylinder 37 also is mounted on the upper end of the mold bonnet extension 31*b* and includes cylinder chamber 37*a* and cylinder rod 37*b* that is moved in the mold bonnet extension 31*b* to raise or lower the mold clamp 17. In particular, after the mold bonnet 31 is lowered and locked with the mold base 13, the cylinder 37 lowers the mold clamp 17 against the top of the mold 15 in the bonnet 31 to clamp the mold 15 and seals MS1 and MS2 against the mold base 13, FIG. 7.

The casting compartment 3 is evacuated using conventional vacuum pumping systems 24*a* and 24*b* shown in FIGS. 1 and 3. The casting compartment vacuum pumping systems 24*a* and 24*b* each include a pair of commercially available pumps to achieve desired negative (subambient) pressure; namely, a Stokes 1739HDBP system which is comprised of a rotary oil-sealed vacuum pump and a Roots-type blower to provide an initial vacuum level of roughly 50 microns and below in casting compartment 3 when isolation valve 2 is closed.

The vacuum pumping systems 24*a* and 24*b* singly or in tandem, individually or simultaneously, evacuate the upper chamber 3*a* of the casting compartment 3 via conduits 24*g*, 24*h*, the ingot charging device 20 described above via branch conduits 24*c*, 24*d* and the temperature measurement device 19 via a flexible conduit (not shown) connecting with conduit 24*d*. The vacuum pumping systems 24*a* and 24*b* also evacuate the mold bonnet extension 31*b* via a pair of flexible conduits 24*e* (one shown in FIG. 1) connected to branch conduit 24*f* and to ports 31*o* (one shown) on opposite diametral sides of the extension 31*b*, FIGS. 1 and 2, and the compartment 3*b* via conduit 24*h*. Conduits 24*e* are omitted from FIG. 3.

Operation of the apparatus detailed above will now be described with respect to FIGS. 10-14. After the melting vessel 5 is charged with ingots I at the ingot charging device 20, it is moved by shaft 4*d* to the instrumentation device 19 where the ingots are melted in the melting compartment 1 under a full vacuum (e.g. 10 microns or less) by energization of the induction coil 11 to input the required thermal energy, FIG. 10. When melting of the ingots in crucible C is completed and the melt is brought to the required casting temperature as determined by temperature measurement device 19 and energization of induction coil 11, a preheated ceramic mold 15 with preheated fill tube 16 and preheated seals MS1 and MS2 are loaded on a mold base 13 on support arm 14*c*, FIG. 10. The support arm 14*c* then is pivoted to place the mold base 13 in the casting compartment 3 via the access door 3*c* with compartment 3 isolated by valve 2 from the melting compartment 1, FIG. 11. The mold bonnet 31 is in the raised position in upper chamber 3*a*.

After the mold base 13 is placed in the casting chamber 3*a*, the mold bonnet 31 is lowered by cylinders 35 to align the locking screws 13*b* in the slot openings 33*b* of the locking ring 33. The worker then rotates (partially turns) the locking ring 33 to lock the mold base 13 against the mold bonnet 31 by cam surfaces 33*s* engaging locking screw heads 13*h*. The mold clamp 17 is lowered by cylinder 37 to engage and hold the mold 15 and seals MS1, MS2 against the mold base 13. The mold base 13 and mold bonnet 31 form a mold chamber MC with mold 15 therein when clamped together. The clamped mold base/bonnet 13/31 then are lifted back into the upper chamber 3*a* of the casting compartment 3, and the mold base support arm 14*c* is swung away by the worker so that the casting compartment door 3*c* can be closed and vacuum tight sealed by closure and locking of the door using door clamps 3*j*, FIG. 12. Both the casting compartment 3 and the secondary mold chamber MC formed within mold base/bonnet 13/31 are evacuated by vacuum pumping systems 24*a*, 24*b* to a rapidly achievable, but very low initial pressure, such as for example 50 microns or less subambient pressure. Continuous pumping is maintained for approximately two full minutes, achieving a significantly more complete vacuum, such as 10 microns or less, than achievable with the process of U.S. Pat. Nos. 3,863,706 and 3,900,064 to remove virtually all gases, both those gases which are free within the casting compartment 3 and the mold chamber MC and those contained within porosity in shell mold 15 and core (not shown) if present in the mold, which gases could be potentially damaging to the reactive liquid metallic material (e.g. nickel base superalloy), if given the opportunity to combine with the more reactive elements in the metallic material to form oxides. If the mold 15 is gas impermeable, the opening to the mold through the snout or fill tube 16 provides access for evacuation.

When melting of the ingots in crucible C is completed and the melt is brought to the required casting temperature as determined by temperature measurement instrumentation 19 and after achieving the necessary vacuum level in the melting and casting compartments 1, 3, the isolation valve 2 is opened by its air actuated cylinder 2*a*. The melting vessel 5 with molten metallic material therein is moved on tracks 6 by actuation of cylinder 4 into the casting compartment 3 beneath the mold base/bonnet 13/31, FIG. 12. The tracks 6 provide both alignment and the mechanical stability necessary to carry the heavy, extended load.

The mold base/bonnet 13/31 then are lowered onto the melting vessel 5, FIGS. 7 and 13, such that the mold base 13 engages the flange 5*z* of the melting vessel 5 and is clamped to it with the argon-actuated toggle clamp locks 34 engaging the flange 5*z* with a 90 degree mechanical latch action. This motion accomplishes two things.

First, the vertical movement of the mold base/bonnet immerses the mold fill tube 16 into the molten metallic material M present as a pool in crucible C.

Second, engagement and clamping of the mold base 13 to the flange 5*z* of melting vessel 5 creates a sealed gas pressurizable space SP between the top surface of the molten metallic material M and the bottom surface 13*e* of the mold base 13. The seal SMB1 is compressed between the mold base 13 and flange 5*z* of the melting vessel to provide a as-tight seal to this end. This small (e.g. typically 1,000 cubic inches) space SP and space around the induction coil 11 of the melting vessel 5 is then pressurized through argon gas supply conduit 4*h* via opening of valve VA and closing vacuum conduit valve VV, while the compartments 1, 3 continue to be evacuated to 10 microns or less, thereby creating a pressure differential on the molten metallic material M in the crucible C required to force or "push" the molten metallic material upwardly through the fill tube 16 into the mold cavities 15*b* via the sprue 15*a* and side gates 15*c*. The argon pressurizing gas is typically provided at a gas pressure up to 2 atmospheres, such as 1 to 2 atmospheres, in the space SP. Maintenance of the positive argon pressure in the sealed space SP typically is continued for the specified casting cycle, during which time the metallic material in mold cavities 15*b* and a portion of the mold side gates 15*c* but typically not the sprue 15*a* has solidified. The melting vessel 5 is constructed to be pressure tight when sealed to the mold base 13 during the gas pressurization step using conduit 4*h* or vacuum tight during the evacuation step using vacuum conduit 4*v* described next.

After termination of the gas pressure by closing valve VA, the space SP and space around the induction coil 11 of the melting vessel 5 are evacuated using vacuum conduit 4*v* with valve VV open to equalize subambient pressure between sealable space SP and the compartments 1, 3. Remaining molten metallic material within the mold sprue 15*a* then can flow back into the crucible C and thereby be available, still in liquid form, for use in the casting of the next mold. The toggle lock clamps 34 are de-pressurized, permitting the mold base/bonnet 13/31 to be raised from the melting vessel 5, withdrawing the fill tube 16 from the molten metallic material in the crucible C. A drip pan 70 then is positioned by hydraulic cylinder 72 under the mold base 13 to catch any remaining drips of molten metallic material from the fill tube 16, FIG. 2.

Figure 14:
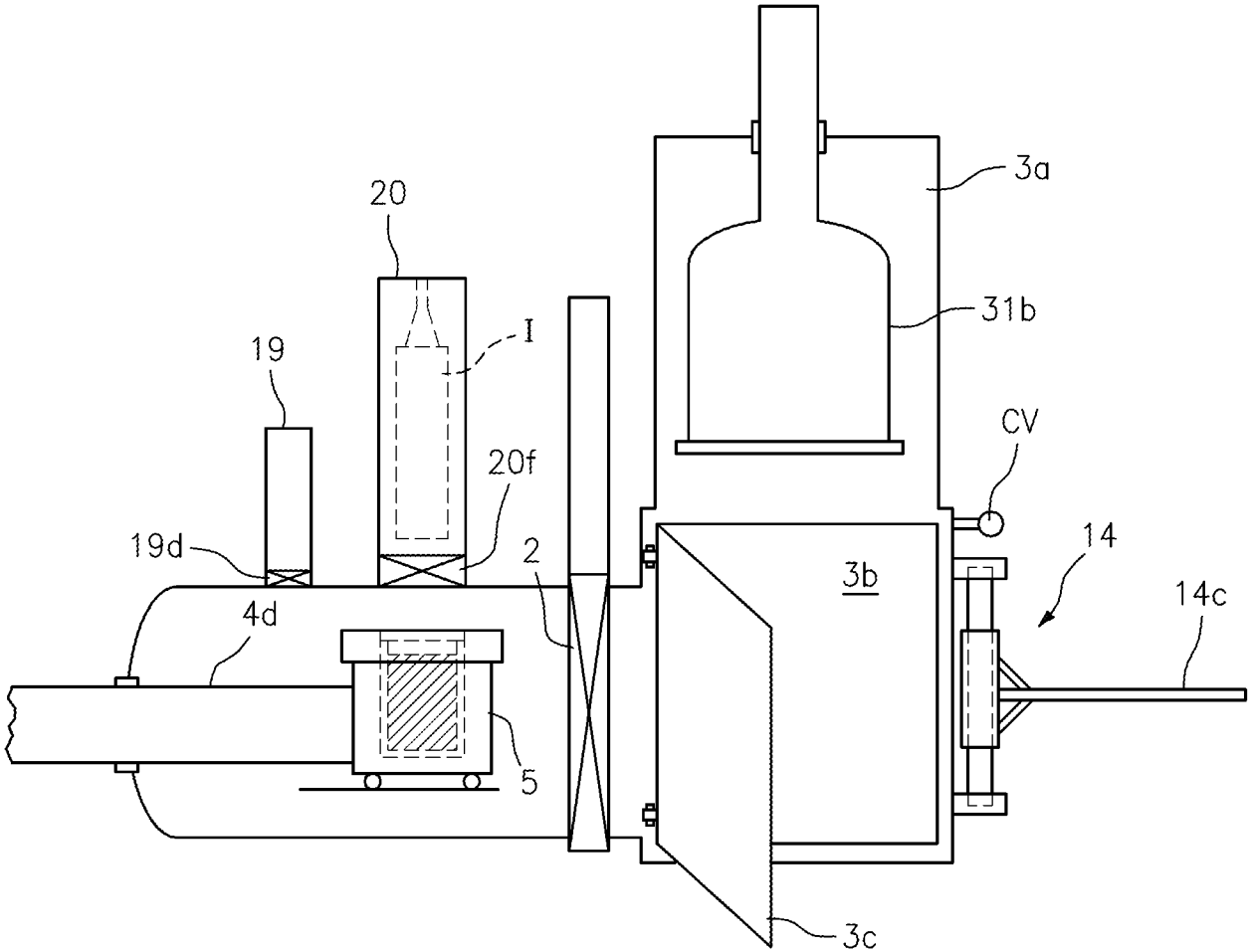

At this point in the casting cycle and as shown in FIG. 14, the melting vessel 5 is withdrawn into the melting compartment 1 and isolated from the casting compartment 3 by closing of isolation valve 2. This allows the vacuum in compartment 3 to be released by ambient vent valve CV, FIG. 14, to provide ambient pressure therein and the door 3*c* to be opened and the cast mold 15 on mold base 13 may be removed using support arm 14*c*. If there is no longer sufficient metallic material remaining in the crucible C to cast another mold, the crucible C is recharged with fresh master alloy using the charging mechanism 20, the new ingots are melted, and the total charge is again prepared for casting by establishing the defined melt casting temperature for the part to be cast. The casting of the molten metallic material into a new mold 15 is conducted in casting chamber 3 as previously described.

The baseline countergravity process purports advantages over prior processes in that the mold 15 is filled with liquid metallic material while the mold is still under vacuum (e.g. 10 microns or less subambient pressure). There is, therefore, no resistance to the entry of metal into the mold cavities created by any sort of gas back pressure within the mold. It is no longer necessary that the mold wall be gas permeable to permit the escape of gases and the entry of metal. Entirely gas impermeable molds can be cast without difficulty, opening many new options with respect to the production of the mold itself, and making process combinations possible which were previously not practical. Further, as stated previously, substantially less interstitial gas, with the potential to form gas bubbles as a result of thermal expansion, remains in ceramic porosity, either in the mold wall or in preformed ceramic cores, such that casting scrap rates are reduced.

The molten metallic material returning from the sprue of the cast mold to the crucible is cleaner than similar recycled material from previous processes, because it, too, has been exposed to less evolved reactive gas during the casting cycle. This is revealed by the relative absence of accumulated dross floating on the surface of the metal remaining in the crucible following a similar number of casting cycles. Additionally, the gas pressurization of the small space above the melt which creates the pressure differential lifting the metal up into the mold can be accomplished more quickly, allowing complete molds to be filled faster, and therefore thinner cast sections to be filled. Greater consistency can be achieved between cavity fill rates at different heights on the same mold because of the elimination of available mold surface area and mold permeability as variables in the mechanics controlling the rate of pressure change within the mold. Pressure differentials greater than one atmosphere can be utilized in the practice of the process. This permits the casting of taller components than could otherwise be produced due to the limitation on how high metal can be lifted by a pressure differential of not more than one atmosphere. It can also assist the feeding of porosity created during casting solidification as a result of the shrinkage which takes place in most alloys as they transition from liquid to solid. This increased pressure can force liquid to continue to progress through the solidification front to fill porosity voids that tend to be left behind. When applied to its full potential, the baseline countergravity process permits the use of smaller or fewer gates, resulting in additional cost reduction. It can also potentially eliminate the need for hot isostatic pressing (HIP'ing) as a means of microporosity elimination, achieving still further cost reduction.

Although the mold bonnet 31 is shown enclosing the mold 15 on mold base 13 and carrying the mold clamp 17, the mold bonnet may be omitted if the mold clamp 17 can otherwise be supported in a manner to clamp the mold 15 onto the mold base 13. That is, the mold 15 on the mold base 13 can communicate directly to casting compartment 3 without the intervening mold bonnet 31 in an alternative embodiment of the baseline process and associated apparatus. Moreover, the baseline envisioned locating the melting compartment 1 below the casting compartment 3 in a manner described in U.S. Pat. No. 3,900,064 such that the melting vessel 5 is moved upwardly into the casting compartment to engage and seal with a mold base 13 positioned therein to form the gas pressurizable space to countergravity molten metallic material into a mold on the mold base.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline casting method and casting system configuration, details of such baseline may influence details of particular implementations. Accordingly, other embodiments are within the scope of the following claims.

What is claimed is:

1. An apparatus for countergravity casting a metallic material, the apparatus comprising:
- a melting vessel;
- a casting chamber containing a mold;
- a fill tube capable of extending into the melting vessel to communicate melted metallic material to the casting chamber; and
- a gas source coupled to a headspace of the melting vessel to allow the gas source to pressurize said headspace to establish a pressure differential to force the melted metallic material upwardly through said fill tube into said mold,
- wherein at least one of the fill tube and mold has a substrate and a surface layer on the substrate, the surface layer of a sulfur-gettering material of greater sulfur-gettering ability than alumina and zirconia.

2. The apparatus of claim 1 wherein:
the sulfur gettering ability is at least that of 20 weight percent MgO in $ZrO_2$.

3. The apparatus of claim 1 wherein:
the mold has a cavity shaped to form a gas turbine engine component.

4. The apparatus of claim 1 wherein:
the sulfur-gettering material comprises CaO.

5. The apparatus of claim 4 wherein:
the surface layer is along the mold.

6. The apparatus of claim 1 wherein:
the surface layer is at least 50 weight percent MgO.

7. The apparatus of claim 1 wherein:
the surface layer is along the mold.

8. The apparatus of claim 7 wherein:
the substrate is an alumina or zirconia substrate; and
a thickness of the surface layer is 0.25 mm to 2.0 mm.

9. The apparatus of claim 8 wherein:
the surface layer has sulfur gettering ability at least that of 20 weight percent MgO in $ZrO_2$.

10. The apparatus of claim 8 wherein:
the sulfur-gettering material comprises CaO.

11. The apparatus of claim 1 wherein:
the sulfur-gettering material comprises at least one of MgO and CaO.

12. The apparatus of claim 1, wherein:
the surface layer comprises at least 50 weight percent material selected from the group consisting of:
- MgO;
- CaO,
- LaO;
- $Y_2O_3$;
- other rare earth element oxide(s) with greater sulfur affinity than $ZrO_2$; and
- combinations thereof.

13. The apparatus of claim 1 wherein:
the surface layer is along the fill tube.

14. The apparatus of claim 13 wherein:
a thickness of the surface layer is 0.25 mm to 2.0 mm.

15. The apparatus of claim 13 wherein:
the sulfur-gettering material comprises LaO.

16. The apparatus of claim 15 wherein:
the surface layer comprises at least 50 weight percent LaO.

17. The apparatus of claim 16 wherein:
the substrate is an alumina or zirconia substrate.

18. The apparatus of claim 1 wherein:
the substrate is an alumina or zirconia substrate; and
a thickness of the surface layer is 0.25 mm to 2.0 mm.

19. A method for using the apparatus of claim 1, the method comprising:
- melting a nickel-based superalloy in a melting crucible;
- disposing the casting mold under subambient pressure on a mold base with a fill tube of said mold extending through an opening in said base;
- relatively moving said melting crucible and said base to immerse an opening of said fill tube in the melted nickel-based superalloy in said melting crucible and to engage said melting crucible and said base with seal means therebetween such that a sealed gas pressurizable space is formed between the melted nickel-based superalloy and said base; and gas pressurizing said space to establish a pressure differential on the melted nickel-based superalloy to force it upwardly through said fill tube into said casting mold, the melted nickel-based superalloy passing through the a filter, wherein the melted nickel-based superalloy contacts the surface layer, the surface layer removing sulfur from the melted nickel-based superalloy.

20. An apparatus for countergravity casting a metallic material, the apparatus comprising:

a melting vessel;

a casting chamber containing a mold;

a fill tube capable of extending into the melting vessel to communicate melted metallic material to the casting chamber; and a gas source coupled to a headspace of the melting vessel to allow the gas source to pressurize said headspace to establish a pressure differential to force the melted metallic material upwardly through said fill tube into said mold, wherein at least one of the melting vessel, fill tube, and mold has a substrate and a surface layer on the substrate, the surface layer of a sulfur-gettering material comprising CaO and the surface layer being of greater sulfur-gettering ability than each of a sulfur-gettering ability of alumina and a sulfur-gettering ability of zirconia.

21. The apparatus of claim 20 wherein:

the substrate is an alumina or zirconia substrate; and a thickness of the surface layer is 0.25 mm to 2.0 mm.

* * * * *